US009451795B2

(12) United States Patent
Krueger

(10) Patent No.: US 9,451,795 B2
(45) **Date of Patent: *Sep. 27, 2016**

(54) IMPACT REDUCTION SYSTEM

(71) Applicant: Wesley W. O. Krueger, San Antonio, TX (US)

(72) Inventor: Wesley W. O. Krueger, San Antonio, TX (US)

( * ) Notice: Subject to any disclaimer, the term of this patent is extended or adjusted under 35 U.S.C. 154(b) by 260 days.

This patent is subject to a terminal disclaimer.

(21) Appl. No.: 14/198,423

(22) Filed: Mar. 5, 2014

(65) Prior Publication Data

US 2014/0173812 A1 Jun. 26, 2014

Related U.S. Application Data

(63) Continuation-in-part of application No. 13/674,755, filed on Nov. 12, 2012, now Pat. No. 8,713,716, which is a continuation-in-part of application No. 12/728,073, filed on Mar. 19, 2010, now Pat. No. 8,347,421, which is a continuation-in-part of application No. 11/828,326, filed on Jul. 25, 2007, now Pat. No. 7,917,972.

(51) Int. Cl.

| | |
|---|---|
| ***A41D 13/015*** | (2006.01) |
| ***A42B 3/12*** | (2006.01) |
| ***F41C 23/08*** | (2006.01) |
| ***A42B 3/04*** | (2006.01) |

(52) U.S. Cl.

CPC ..... *A41D 13/015* (2013.01); *A41D 13/0151* (2013.01); *A41D 13/0155* (2013.01); *A42B 3/046* (2013.01); *A42B 3/122* (2013.01); *F41C 23/08* (2013.01)

(58) Field of Classification Search

CPC ..... A41D 13/08; A41D 13/015; A41D 13/0012; A41D 13/0518; A41D 13/0015; A41D 3/00; A41D 13/018; F41H 1/02; A42B 3/06

USPC ..... 2/16, 455, 2.5, 94, 267, 412, 69, 108, 2/459, DIG. 3

See application file for complete search history.

(56) References Cited

U.S. PATENT DOCUMENTS

| | | | |
|---|---|---|---|
| 1,587,946 | A | 6/1926 | Gibson |
| 1,774,060 | A | 8/1930 | Hodge |
| 2,438,142 | A | 3/1948 | Brower |

(Continued)

*Primary Examiner* — Tejash Patel

(74) *Attorney, Agent, or Firm* — Kilpatrick Townsend & Stockton LLP

(57) ABSTRACT

A wearable impact reduction device and method are disclosed. The wearable device and method comprise three layers, the middle layer of which comprises a resilient element that displaces as a result of an impact. The device and method also comprise the use of a motion sensor and a physiologic biosensor. In at least one embodiment, one of the layers of the device can be responsive to one of the sensors. In at least one embodiment, the motion sensor can comprise an accelerometer, a gyroscope, a magnetometer, an acoustic sensor, an infrared sensor, or a GPS (global positioning system) receiver and the motion sensor can be responsive to acceleration, position, or velocity. In at least one embodiment, the physiologic biosensor can sense blood pressure, body temperature, blood volume, calorie consumption, electro-cardio activity, heart rate, hematocrit, hemoglobin, infrared thermographic information, neural/brain activity, percent oxygenation, respiratory acidosis, respiratory rate, rhythm disturbance, vital signs, or a blood chemistry characteristic such as alcohol level, electrolyte level, glucose level, hydration level, pH, or oxygen saturation.

20 Claims, 21 Drawing Sheets

(56) References Cited

U.S. PATENT DOCUMENTS

| | | | | | |
|---|---|---|---|---|---|
| 3,248,738 | A * | 5/1966 | Morgan | A41D 13/015 2/414 |
| 3,257,666 | A | 6/1966 | Hoffman | |
| 3,872,511 | A | 3/1975 | Nichols | |
| 4,353,133 | A | 10/1982 | Williams | |
| 4,375,108 | A | 3/1983 | Gooding | |
| 4,493,115 | A | 1/1985 | Maier et al. | |
| 4,922,641 | A | 5/1990 | Johnson | |
| 5,095,545 | A | 3/1992 | Lane | |
| 5,265,366 | A | 11/1993 | Thompson | |
| 5,375,360 | A | 12/1994 | Vatterott | |
| 5,461,813 | A | 10/1995 | Mazzola | |
| 5,500,952 | A * | 3/1996 | Keyes | A41D 13/018 2/465 |
| 5,621,922 | A | 4/1997 | Rush | |
| 5,636,377 | A * | 6/1997 | Wiener | A41D 13/015 2/2.5 |
| 5,978,972 | A | 11/1999 | Stewart et al. | |
| 6,029,962 | A | 2/2000 | Shorten et al. | |
| 6,257,562 | B1 | 7/2001 | Takashima et al. | |
| 6,453,477 | B1 | 9/2002 | Bainbridge et al. | |
| 6,588,023 | B1 | 7/2003 | Wright | |
| 6,684,547 | B2 | 2/2004 | Poff | |
| 6,730,047 | B2 | 5/2004 | Socci et al. | |
| 6,758,466 | B2 | 7/2004 | Russell | |
| 6,826,509 | B2 | 11/2004 | Crisco et al. | |
| 6,834,456 | B2 | 12/2004 | Murello | |
| 6,941,952 | B1 | 9/2005 | Rush | |
| 6,976,333 | B2 | 12/2005 | Sims | |
| 7,055,277 | B2 | 6/2006 | Sims | |
| 7,082,621 | B1 | 8/2006 | Fratesi | |
| 7,150,048 | B2 | 12/2006 | Buckman | |
| 7,152,356 | B2 | 12/2006 | Sims | |
| 7,168,104 | B2 | 1/2007 | Tobergte | |
| 7,204,165 | B1 | 4/2007 | Plaga et al. | |
| 7,232,118 | B2 | 6/2007 | Maeno et al. | |
| 7,376,978 | B2 | 5/2008 | Godshaw | |
| 7,386,401 | B2 | 6/2008 | Vock et al. | |
| 7,509,835 | B2 | 3/2009 | Beck | |
| 7,526,389 | B2 | 4/2009 | Greenwald et al. | |
| 7,774,866 | B2 | 8/2010 | Ferrara | |
| 7,917,972 | B1 | 4/2011 | Krueger | |
| 8,232,881 | B2 | 7/2012 | Hertz | |
| 8,258,799 | B2 | 9/2012 | Bernstein | |
| 8,347,421 | B2 | 1/2013 | Krueger | |
| 8,713,716 | B2 * | 5/2014 | Krueger | A41D 13/0002 2/412 |
| 2006/0074338 | A1 | 4/2006 | Greenwald et al. | |
| 2006/0254112 | A1 | 11/2006 | Snoderly | |
| 2013/0125295 | A1 | 5/2013 | Krueger | |

* cited by examiner

IMPACT REDUCTION SYSTEM

CROSS-REFERENCE TO RELATED APPLICATIONS

This application is a continuation-in-part of U.S. application Ser. No. 13/674,755 filed Nov. 12, 2012, which is a continuation-in-part of U.S. application Ser. No. 12/728,073 filed Mar. 19, 2010, now U.S. Pat. No. 8,347,421, which is a continuation-in-part of U.S. application Ser. No. 11/828,326, filed Jul. 25, 2007, now U.S. Pat. No. 7,917,972, which are hereby incorporated by reference in their entirety.

BACKGROUND

The present invention generally relates to devices for absorbing shock. More particularly, the present invention relates to impact reduction devices for use in contact sports, gravity game sports, marksmanship, military or security activities, or other activities where protection from impact or projectiles is desired. Impact reduction devices may be directly placed against a part of the human body, they may be incorporated into an article of clothing, they may be part of a helmet, or they may be part of a device external to the user's body that serves to help reduce impact and/or prevent the penetration of projectiles.

Protective pads are used in a variety of applications to protect the body from injury-causing physical impact. For example, athletes often wear protective pads while playing sports, such as American football, hockey, soccer, gravity game sports, and baseball, among others. In addition, many marksmen wear protective pads while shooting firearms to increase their accuracy and protect their bodies from forces associated with firearm recoil.

In the case of marksmanship, not only will the recoil of a gun cause potential injury, but it may also affect the accuracy of the marksman. For example, if the marksman anticipates a recoil, he may flinch upon firing the gun. This flinching may disturb the alignment of the gun as it is fired leading to missed shots and inaccuracies. Use of a device to absorb the shock of the recoil may help to avoid flinching because the impact of the recoil against the marksman's body may be softened.

In the athletic industry, many pads are constructed of high-density molded plastic material combined with open or closed cell foam padding. This padding is stiff and absorbs the energy of an impact force, dissipating that energy over an expanded area. Thus, any one point of the body is spared the full force of the impact, thereby reducing the chance of injury.

Another type of pad often used in the athletic industry utilizes a honeycomb structure designed to be rigid in the direction of the impact, but flexible in a direction perpendicular to the impact. Upon application of an impact force, the honeycomb structure is deformed or crumpled in order to absorb as much of the potentially damaging impact as possible. In this way, less of the total kinetic energy of the impact is transferred to the body, while the impact reduction remains in the plane of the impact.

Similarly, in the firearm industry, a marksman may use a recoil buffer or arrestor to cushion the impact of a firearm as it recoils. Many recoil buffers are pads formed of a resilient material, such as leather, gel, foam, or rubber. Pads may be worn on the marksman's body or they may be formed as an integral part of a firearm, such as a rubber butt pad on a shotgun. The purpose of recoil buffers is similar to that of the athletic pads discussed above. That is, to absorb and disperse the energy of a recoil impact to protect the body of the marksman.

There are shortcomings with pads currently available for use in athletic and marksmanship applications. For example, athletes must often be quick and have freedom of movement. Existing athletic padding is generally heavy and bulky. In the case of padding having a honeycomb structure, the padding is rigid. Thus, use of existing pads decreases the ability of an athlete to move quickly and limits the athlete's freedom of movement. Many football players, for example, avoid the use of hip or thigh pads because of their weight, bulkiness, and the limiting effect that such pads have on mobility.

In the case of firearms, existing recoil buffers too often fail to disperse the kinetic energy of a recoil in a broad way. The result is that the full impact force of the recoil is concentrated in a localized area, resulting in flinching and possible injury.

Therefore, it is desirable to provide an impact reduction pad that overcomes the disadvantages of the prior art and can have uses in many applications. The ideal impact material or padding should absorb, distribute and/or dissipate the force of impact superior to what is currently available. The goal of impact materials used for body protection is to be protective, lightweight, thin and flexible, thus not interfering with body movements or speed. In some situations, it is desired to have an impact material or pad that incorporates embedded smart or active physiologic sensing materials or devices, such as sensors that provide biofeedback to modify the characteristics of the padding material to prevent tissue or bone injury or its consequences and/or could inform the wearer or others of the wearer's physiologic status. Smart impact pads and materials could have integrated sensor systems, which can monitor the biomechanical and physiological responses to detect injury and quantify the impacts. These integrated sensors in the padding can measure and integrate the directional and rotational impact force into real-time data that can be interpreted and organized. The sensor system can allow the padding to be tuned. These smart pads could also have biosensors capable of monitoring physiologic and/or biochemical parameters and could detect abnormal values, such as values that might adversely affect human performance. Data from the sensors could be transmitted to inform other devices or people.

SUMMARY

One aspect of the present invention provides pads and systems incorporating pads that have improved impact reduction resulting from the geometries, configuration, and/or materials chosen. Another aspect of the present invention provides pads and systems incorporating pads that have increased intelligence in the form of sensors and information processing.

BRIEF DESCRIPTION OF THE DRAWINGS

The present invention will be better understood on reading the following detailed description of non-limiting embodiments thereof, and on examining the accompanying drawings, in which.

Figure 1:
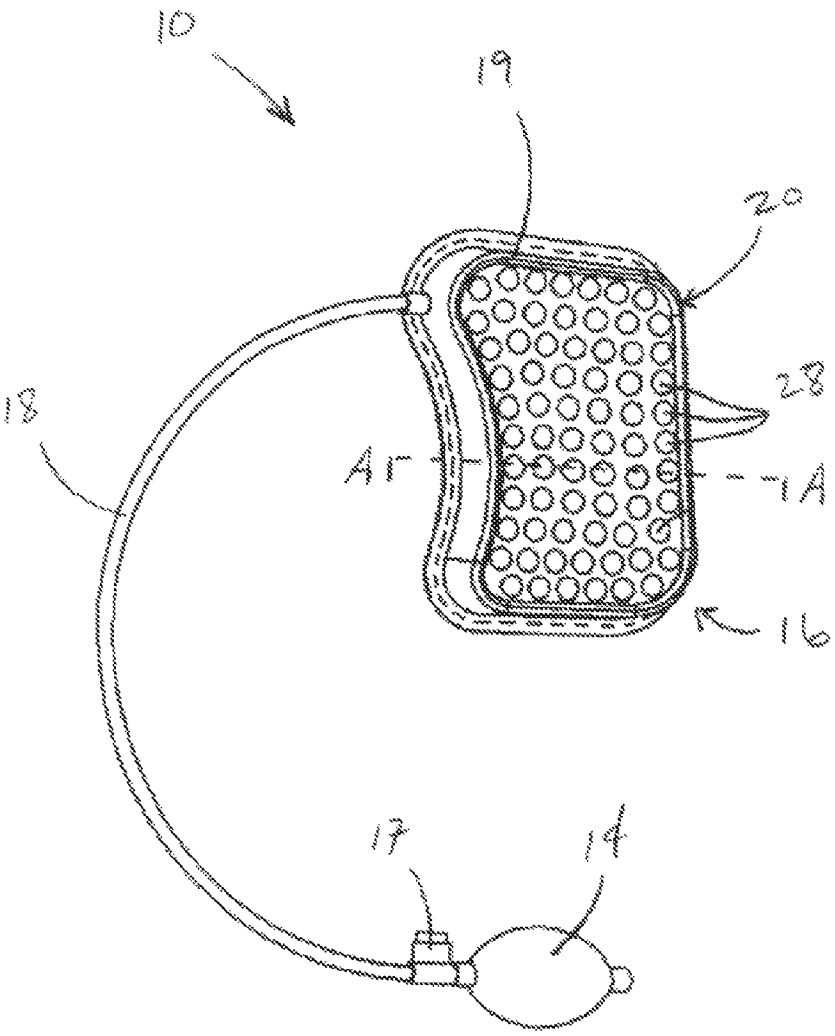
FIG. 1 is a front, perspective view of an embodiment of the present invention.

It should be understood that the drawings are not necessarily to scale. In certain instances, details that are not necessary for an understanding of the invention or that render other details difficult to perceive may have been omitted. It should be understood that the invention is not necessarily limited to the particular embodiments illustrated herein.

DETAILED DESCRIPTION

The ensuing description provides preferred exemplary embodiment(s) only, and is not intended to limit the scope, applicability or configuration of the disclosure. Rather, the ensuing description of the preferred exemplary embodiment(s) will provide those skilled in the art with an enabling description for implementing a preferred exemplary embodiment. It should be understood that various changes could be made in the function and arrangement of elements without departing from the spirit and scope as set forth in the appended claims.

Specific details are given in the following description to provide a thorough understanding of the embodiments. However, it will be understood by one of ordinary skill in the art that the embodiments may be practiced without these specific details.

This disclosure describes protective padding. The protective padding described could conform to any requirement or be manufactured to any shape or thickness, depending on where it is placed on the body and what type of impact it is likely to incur to be used for the purpose to mitigate and dissipate excessive forces transmitted to the human body or skull. This padding is different as it can actively respond to impacts and is not only passive to impacts or concussions. It can be self-adjusting and tunable, such as making changes to stiffness or damping. These changes in stiffness and damping can be in response to signals received from a sensor or sensors and/or a controller. Impact data could be transmitted to remote sources. The materials used can include lightweight, thin, flexible materials or polymers, and other innovative fabric materials that are comfortable and can adapt to sudden impacts.

Active and passive sensors could be embedded in the impact material. The sensors embedded in the padding can be responsive to acceleration, orientation, position, velocity, and have the ability to sense the presence of another object or device in the vicinity. These integrated sensors in the padding can measure and integrate the directional and rotational impact force into real-time data that can be interpreted and organized. These sensors could sense an impending impact with another moving object or stationary object or stable platform. The active sensors could then alter the padding material prior to the impact in a manner to be more protective, than in the "inactive" or pre-impact state. The sensors could detect the velocity of the oncoming object or person. The sensors could also detect the degree of impact and instantly alter the impact material or padding to adapt to a more protective state. Sensors related to an inflatable air system or fluid system, could internally adjust the amount of air in the sealed system, or be tuned, to adapt to impacts or impending impacts to the body. Sensors could also initiate the inflation of an external air bag. Damping characteristics of any impact material/padding could be correlated in real-time with the weight, speed and impact history of the user or athlete. The sensors, embedded in the impact material, in another embodiment could have GPS (Global Positioning System) capability, providing location and active tracking capabilities.

Embedded sensors in the pads could be self-adjusting, dependent on air pressure (external or atmospheric and internal) and temperature (external or atmospheric and internal) and to what has been pre-determined to be normal pressure in the padding for specific activities or impacts. These sensors could have impact threshold settings and remotely the settings can be established and maintained.

The pads can comprise physiologic biosensors that could provide real time and continued bioparametric information to remote locations. In embodiments of the present invention, the data received from the physiologic biosensors described in this disclosure and/or stored by the system could be used to detect abnormal values and initiate actions to inform the wearer and/or remote observers. The term physiologic biosensors as used in this disclosure means any transducer that converts a biological parameter (i.e. bioparameter) to a signal that can be measured by the impact pad system.

Skin sensors can be used in embodiments of the present invention to detect physiologic bioparameters of the wearer, such as of vital signs and blood chemistry values. Additionally these physiologic biosensors could detect not only normal values but abnormal values, which would affect the human performance. The skin sensors could require skin contact and embodiments of the present invention can use nanoscale physiologic biosensors.

For example, embodiments of the present invention could detect respiratory acidosis. Respiratory acidosis is a condition in which a build-up of carbon dioxide in the blood produces a shift in the body's pH balance and causes the body's system to become more acidic. This condition is brought about by a problem either involving the lungs and respiratory system or signals from the brain that control breathing. Respiratory acidosis may be suspected based on symptoms. A blood sample to test for pH and arterial blood gases can be used to confirm the diagnosis. In this type of acidosis, the pH will be below 7.35. The pressure of carbon dioxide in the blood will be high, usually over 45 mmHg. Physiologic biosensors on the skin can detect the pH, oxygen saturation or percent (%) of oxygenation in the body. Abnormal levels will affect the human performance. Measuring and monitoring of vital signs and blood chemistry values could be logged over time these embedded physiologic biosensors.

Embodiments of the present invention could detect blood pressure. The term hypertensive emergency is primarily used as a specific term for a hypertensive crisis with a diastolic blood pressure greater than or equal to 120 mmHg and/or systolic blood pressure greater than or equal to 180 mmHg. Hypertensive emergency differs from hypertensive crisis in that, in the former, there is evidence of acute organ damage. In physiology and medicine, hypotension is low blood pressure, especially in the arteries of the systemic circulation. Blood pressure is the force of blood pushing against the walls of the arteries as the heart pumps out blood. Hypotension is generally considered to be systolic blood pressure less than 90 millimeters of mercury (mm Hg) or diastolic less than 60 mm Hg.

Embodiments of the present invention could detect heart function, such as heart rate, blood pressure, and rhythm disturbances of the heart. A normal heart beats in a steady, even rhythm, about 60 to 100 times each minute (that's about 100,000 times each day). Bradycardia is the resting heart rate of under 60 beats per minute (BPM), although it is seldom symptomatic until the rate drops below 50 BPM. It sometimes results in fatigue, weakness, dizziness and at very low rates fainting. Bradycardia during sleep is considered normal and rates around 40-50 BPM are usual. A diagnosis of bradycardia in adults is based on a heart rate less than 60 BPM. This is determined usually either via palpation or an EKG. Tachycardia is a heart rate that exceeds the normal range. A resting heart rate over 100 beats per minute is generally accepted as tachycardia. Tachycardia can be caused by various factors that often are benign. However, tachycardia can be dangerous depending on the speed and type of rhythm. Note that if it is pathological, a tachycardia is more correctly defined as a tachyarrhythmia. The upper threshold of a normal human resting heart rate is based upon activity, exercise with exertion and age. Tachycardia for different age groups is as listed below.

8-11 years: >130 BPM 12-15 years: >119 BPM

>15 years-adult: >100 BPM

When the heart beats excessively or rapidly, the heart pumps less efficiently and provides less blood flow to the rest of the body, including the heart itself. The increased heart rate also leads to increased work and oxygen demand by the heart, which can lead to rate related ischemia. Cardiac arrhythmias are disturbances in the normal rhythm of the heartbeat. An occasional palpitation or fluttering is usually not serious, but a persistent arrhythmia may be life threatening. There are many different types of cardiac arrhythmias. The heart may beat too rapidly, known as atrial tachycardia, or too slowly, known as bradycardia, or it may beat irregularly. Atrial fibrillation and atrial flutter are common cardiac arrhythmias, which lead to an irregular and sometimes rapid heart rate. These atrial arrhythmias may interfere with the heart's ability to pump blood properly from its upper chambers (atria). In ventricular fibrillation, the lower chambers of the heart (ventricles) quiver feebly instead of contracting powerfully. This is the most severe type of arrhythmia, causing death in minutes unless medical assistance is obtained immediately. These arrhythmias can be caused by several factors and one of which is dehydration or depletion of potassium or other electrolytes. Dehydration results in decreased blood volume returning to the heart and can also cause electrolyte imbalances in your blood (such as low levels of sodium or potassium). Low or high levels of electrolytes can affect the electrical impulses of the heart.

Embodiments of the present invention could use physiologic biometric sensors to detect real-time dehydration and/or electrolyte abnormalities with the wearer of the material or padding. The level of hydration in the human body is carefully adjusted to control the electrolyte balance that governs the biochemical processes that sustain life. An electrolyte deficiency caused by dehydration or over-hydration will not only limit human performance, but can also lead to serious health problems and death if left untreated. It can be also used for alcohol monitoring.

Medical infrared thermography (MIT) can provide a non-invasive and non-radiating analysis tool for analyzing physiological functions related to the control of skin-temperature. This rapidly developing technology can be used to detect and locate thermal abnormalities characterized by an increase or decrease found at the skin surface. The technique involves the detection of infrared radiation that can be directly correlated with the temperature distribution of a defined body region. Infrared thermal imaging technique is an effective technique for detecting small temperature changes in the human body due to vascular disorders. There is a definite correlation between body temperature and diseases. An injury is often related with variations in blood flow and these in turn can affect the skin temperature. Inflammation leads to hyperthermia, whereas degeneration, reduced muscular activity and poor perfusion may cause a hypothermic pattern. Infrared sensor technology can provide information for the functional management of injuries in human athletes.

Embodiments of the present invention could include physiologic biosensors that measure neural activity such as brain activity, when placed in contact with the skin on the head. Electroencephalography (EEG) is one of the methods used to record the electrical potential along the scalp produced by the neurons within the brain. Some waveforms in the EEG signal are highly correlated with the individual's sleepiness level. Electrical activity emanating from the brain is displayed in the form of brainwaves. There are four categories of these brainwaves, ranging from the most activity to the least activity: beta; alpha, theta and delta.

When the brain is aroused and actively engaged in mental activities, it generates beta waves. These beta waves are of relatively low amplitude, and are the fastest of the four different brainwaves. The frequency of beta waves ranges from 15 to 40 cycles a second. Beta waves are characteristics of a strongly engaged mind. A person in active conversation would be in beta. A debater would be in high beta. A person making a speech, or a teacher, or a talk show host would all be in beta when they are engaged in their work.

The next brainwave category in order of frequency is alpha. Where beta represented arousal, alpha represents non-arousal. Alpha brainwaves are slower and higher in amplitude. Their frequency ranges from 9 to 14 cycles per second. A person who has completed a task and sits down to rest is often in an alpha state. A person who takes time out to reflect or meditate is usually in an alpha state. A person who takes a break from a conference and walks in the garden is often in an alpha state.

The next state, theta brainwaves, are typically of even greater amplitude and slower frequency. This frequency range is normally between 5 and 8 cycles a second. A person who has taken time off from a task and begins to daydream is often in a theta brainwave state.

The final brainwave state is delta. Here the brainwaves are of the greatest amplitude and slowest frequency. They typically center on a range of 1.5 to 4 cycles per second. They never go down to zero because that would mean that you were brain dead. But, deep dreamless sleep would take you down to the lowest frequency—typically 2 to 3 cycles a second.

When we go to bed and read for a few minutes before attempting sleep, we are likely to be in low beta. When we put the book down, turn off the lights and close our eyes, our brainwaves will descend from beta, to alpha, to theta and finally, when we fall asleep, to delta. It is a known fact that humans dream in 90-minute cycles. When the delta brainwave frequencies increase into the frequency of theta brainwaves, active dreaming takes place and often becomes more experiential to the person.

When an individual awakes from a deep sleep in preparation for getting up, their brainwave frequencies will increase through the different specific stages of brainwave activity. That is, they will increase from delta to theta and then to alpha and finally, when the alarm goes off, into beta. If that individual hits the snooze alarm button they will drop in frequency to a non-aroused state, or even into theta, or sometimes fall back to sleep in delta. During this awakening cycle it is possible for individuals to stay in the theta state for an extended period of say, five to 15 minutes—which would allow them to have a free flow of ideas about yesterday's events or to contemplate the activities of the forthcoming day. This time can be an extremely productive and can be a period of very meaningful and creative mental activity.

In summary, there are four brainwave states that range from the high amplitude, low frequency delta to the low amplitude, high frequency beta. These brainwave states range from deep dreamless sleep to high arousal. The same four brainwave states are common to the human species. Men, women and children of all ages experience the same characteristic brainwaves. They are consistent across cultures and country boundaries. These brainwave patterns can have value in specific occupations, activities or after suffering an impact injury, whether it is a penetrating injury or blunt trauma. Any trauma to the brain, or any physiologic condition affecting the blood chemistries of the body or heart function can result in changes in the brainwave states. This information can be transmitted to a remote source to monitor the health, and performance, of the wearer or user.

Research has shown that although one brainwave state may predominate at any given time, depending on the activity level of the individual, the remaining three brain states are present in the mix of brainwaves at all times. In other words, while somebody is an aroused state and exhibiting a beta brainwave pattern, there also exists in that person's brain a component of alpha, theta and delta, even though these may be present only at the trace level. Embodiments of the present invention could also include physiologic biosensors that measure more distal neural activity such as peripheral neural activity, when placed in contact with the skin on the extremities.

Abnormal physical, mechanical and thermal conditions are introduced in individuals using a prosthesis, such as where the socket contacts the skin. Excessive tension, pressure, friction or heat can traumatize skin and underlying soft tissue. Prostheses have a snug-fitting socket in which air cannot circulate easily and which may trap perspiration. The socket has to provide for weight bearing or tension activities and any uneven loading or pressure, due to a poor fitting prosthesis, may cause stress, chafing or breakdown on localized areas of the stump skin. Prosthetic socks are an important part of the prosthesis fit, but socks are not always the best solution. Embodiments of the invention can include active sensors elements on the prosthetic to improve the fitting of the prosthesis by self-altering or tuning the padding to allow the interface between the prosthesis and stump of the limb.

Embodiments of the invention can include elements that produce auditory signals or alarms, when the physiologic biosensors detect an abnormality. The signal can be conveyed to the wearer of the pad and/or to a remote observer. Embodiments can also include other abnormal physiology based biometric or physiology-based sensors and algorithms not mentioned in this disclosure that are capable of being understood by anyone skilled in the art. The alarms can be triggered as a result of abnormal values detected by a physiological biosensor. These abnormal values can also be sent via a wired or wireless protocol (such as WiFi, a cellphone signal, or by Blue Tooth technology), in real time, to the wearer or to a remote source to notify the remote location of the status of the person wearing the padding with sensor in contact with the body. Additionally, the wearer and/or remote source could receive an alarm, or signal which can be in the group of auditory, visual or tactile signals or alarms. Haptic physiologic biosensors can trigger the signal to the wearer of the padding when there are abnormal values that can affect physiologic or cognitive performance.

The sensors can be made of a variety of materials including nanotubes of pure carbon, graphene made of pure carbon, single electron transistors (SETs), organic molecular materials, magnetoelectronic materials (spintronics), organic or plastic electronics, or any other material capable of being understood by someone skilled in the art. Motion type of sensors can include GPS (global positioning system), accelerometers, gyroscopes, magnetometers, acoustic sensors, and infrared sensors.

Embodiments of the present invention could use a variety of types of impact reduction mechanisms to reduce impact and dissipate the impact force. Examples include springs, pistons, gases, fluids and polymers. Various configurations and combinations of the padding and impact materials can be included in the embodiments.

Springs are elastic objects used to store mechanical energy. They can return to their original shape when the force is released. In other words it is also termed as a resilient member. Springs can be made from spring steel. Some non-ferrous metals are also used including phosphor bronze and titanium for parts requiring corrosion resistance and beryllium copper. Springs can also be manufactured from elastic materials other than metals. Springs used for reduction of impacts can be classified depending on how the load force is applied to them or classified based on their shape:

- Compression springs are designed to operate with a compression load, so the spring gets shorter as the load is applied to it;
- Torsion springs respond to a rotational or twisting load;
- Constant force springs have the same resistance throughout the deflection cycle;
- Variable force springs have a resistance that changes (typically increases) with deflection;
- Coil springs are made out of a coil or helix of elastic material;
- Flat springs are made of a flat or conical shaped piece of wire or other elastic material;
- Cantilever springs are fixed on only one end;
- Conical springs are a type of type of torsion spring in which the spring wire is twisted when the spring is compressed or stretched;
- Compression springs are designed to become shorter when loaded;
- Volute springs are compression springs shaped in a cone so that under compression the coils are not forced against each other, thus permitting longer travel;
- Leaf springs are flat springs, sometimes semi-elliptical springs; because they take the form of a slender arc;
- Belleville springs are disc shaped spring used where high capacity compression springs must fit into a small space; and
- Gas springs operate on the principle that a volume of gas must be compressed.

A spring can be linear or non-linear. Linear springs are springs where the force that stretches or compresses the spring is in direct proportion to the amount of stretch. That is, the force vs. extension graph forms a straight, positively sloped line that passes through the origin. For example, when you compress the spring, work is done on the spring, and that work is stored as energy in the spring. It is shaped like a triangle; so, its area is one half times its height times its base. Some linear springs store energy through compression, rather than extension. The formula for the amount of energy stored in a linear spring due to compression is the same as the one for extension. As long as they are not stretched or compressed beyond their elastic limit, most springs obey Hooke's law, which states that the force with which the spring pushes back is linearly proportional to the distance from its equilibrium length. Nonlinear springs have a nonlinear relationship between force and displacement. A graph showing force vs. displacement for a nonlinear spring will be more complicated than a straight line, with a changing slope. The kinetic energy at impact, which is equal to the potential energy of the moving object, is a major factor to consider when choosing the best impact absorbing material for an application. Cushioning efficiency is dependent on not only the energy density of the impact, but also the speed of that impact.

A material whose impact reduction efficiency alters as a result of a change in impact speed exhibits strain-rate dependence. A strain-hardening material, as the name suggests, hardens when compressed at a high strain rate. Some materials exhibit some level of strain-hardening, and different formulations of the same material exhibit this behavior to a larger degree than others.

A shock absorber mechanism can also dampen impact. The basic function of the shock absorber is to absorb and dissipate the impact kinetic energy to the extent that accelerations are reduced to a tolerable level. The amount of damping produced is proportional to velocity. This means the damper works like a dynamic spring; it produces force only when it is moving. The single-acting cylinder is pressurized at one end only, with the opposite end vented to atmosphere or vented to a reservoir. A tandem cylinder consists of two cylinders mounted in line with the pistons, connected by a common piston rod. The main advantage of this cylinder is the multiplication of force, during the entire stroke. The linear piston creates a force curve that features an increase in force directly related to an increase in speed—the quicker the shock moves, the stiffer it becomes.

Although the compression orifice could be merely a hole in the orifice plate, an embodiment of this invention can enable a sensor to measure the velocity of the impact and can regulate or dictate the amount of air released from the cylinder mechanism. Specifically the active sensor can detect the force of the impact and therefore can adjust the valve mechanism (e.g. greater force, the smaller the valve or hole opening). The compressed air escaping the piston mechanism is released into the sealed pad and expands the piston rod back to its position or this can also be done by using spring within the piston shaft—as the piston is compressed (absorption of impact) the air is displaced to the surrounding air around the pistons (resulting in more broad displacement of impact). The compressed air in the sealed pad with the compressed spring would re-expand the piston mechanism.

In order to achieve linear motion from compressed air, a system of pistons can be used. The compressed air can be fed into the chamber that houses the shaft of the piston. Also inside this chamber a spring is coiled around the shaft of the piston in order to hold the chamber completely open when air is not being pumped into the chamber. As air is fed into the chamber the force on the piston shaft begins to overcome the force being exerted on the spring. As more air is fed into the chamber, the pressure increases and the piston begins to move down the chamber. When it reaches its maximum length the air pressure is released from the chamber and the spring completes the cycle by closing off the chamber to return to its original position.

In an embodiment of this invention, the padding itself can act as a piston mechanism and when the padding is compressed the internal air is compressed and forces air into the chamber around the shaft of the piston.

In another embodiment porous materials can be used to reduce weight and absorb energy. Metal foams are a class of cellular materials and have many interesting properties such as high stiffness in conjunction with low specific weight combined with good energy absorption characteristics. These unique characteristics make them useful for applications range from automobile bumpers to aircraft crash recorders. Outer shell in motorcycle helmets can be one such application for metal foams. In a helmet, besides the energy absorbed by the polymer foam, metal foams can also absorb energy because of their porous nature and can prevent the penetration of sharp objects. Metal foams based on aluminum or nickel are the most commonly used at present in various applications. The metal foam is deformed at the impact region and shape of the geometry is changed i.e. becomes flat locally after impact. The permanent deformation of the metal foam with one impact is its draw back. It can therefore be used only for one impact. In one embodiment of the present invention, the impact pad can be comprised of metal foam or another similar single use impact-absorbing material. One of the benefits of a metal foam can be that it resists with a constant force as a function of displacement, a characteristic that will be discussed further in a later section of this disclosure with reference to FIG. 20. Padding covering any area of the body can be worn with such single use impact materials, as the padding can be changed after each impact or if there is permanent deformation of the impact material, which would affect future penetrations or impacts.

The ideal material would be a thin, lightweight and flexible material having a linear force displacement curve. Depending on the portion of the body requiring impact protection, the padding cannot always be thin.

For example, studies of head impacts in football show that concussions occur when a person receives one or more hits that induce linear head accelerations of greater than about 80 g or rotational head accelerations of greater than about 5000 rad/sec$^2$. An analysis of the speed at impact shows that a world-class sprinter can run about 10 m/sec (23 miles/hour). A 4-minute mile is equivalent to 6.7 m/sec, which is about ⅔ of the speed of a world-class sprinter. Football helmet test standards use 12 mile/hour impacts, which equals approximately 5 m/sec or half of the speed of a world-class sprinter. The padding on a typical football helmet is less than 1 inch thick. From physics:

$$x=(0.5)at^2$$

$$v=at \text{ (if acceleration is constant)}$$

where: x is displacement, v=velocity, a=acceleration, and t=time

If one solves the above equations for constant deceleration from 5 m/sec to 0 m/sec in 1 inch ($1/40^{th}$ of a meter or 25 millimeters), the result is 500 m/sec$^2$ or approximately 50 g (the acceleration of gravity is approximately 10 m/sec$^2$). This means that padding that perfectly decelerates from 5 m/sec to 0 in 25 mm (1 inch) could theoretically provide a constant deceleration rate of 50 g. However, the padding on a helmet is far from this optimum in that (a) it doesn't provide a full inch of travel in actual use and (b) it doesn't provide the constant resistive force needed for perfect linear deceleration. Furthermore athletes may sprint at speeds that create an impact having an initial velocity of greater than 12 miles per hour. A calculation of rotational accelerations based on typical current football helmet configurations shows that a one inch of rotation of the outer shell of a 12 inch helmet to stop an initial radial velocity of 12 miles/hour (5 msec) at a radius of 6 inches generates an angular acceleration of about 5000 rad/sec$^2$ which is the concussion threshold as the threshold for linear acceleration (or deceleration) of the head.

Figure 2:
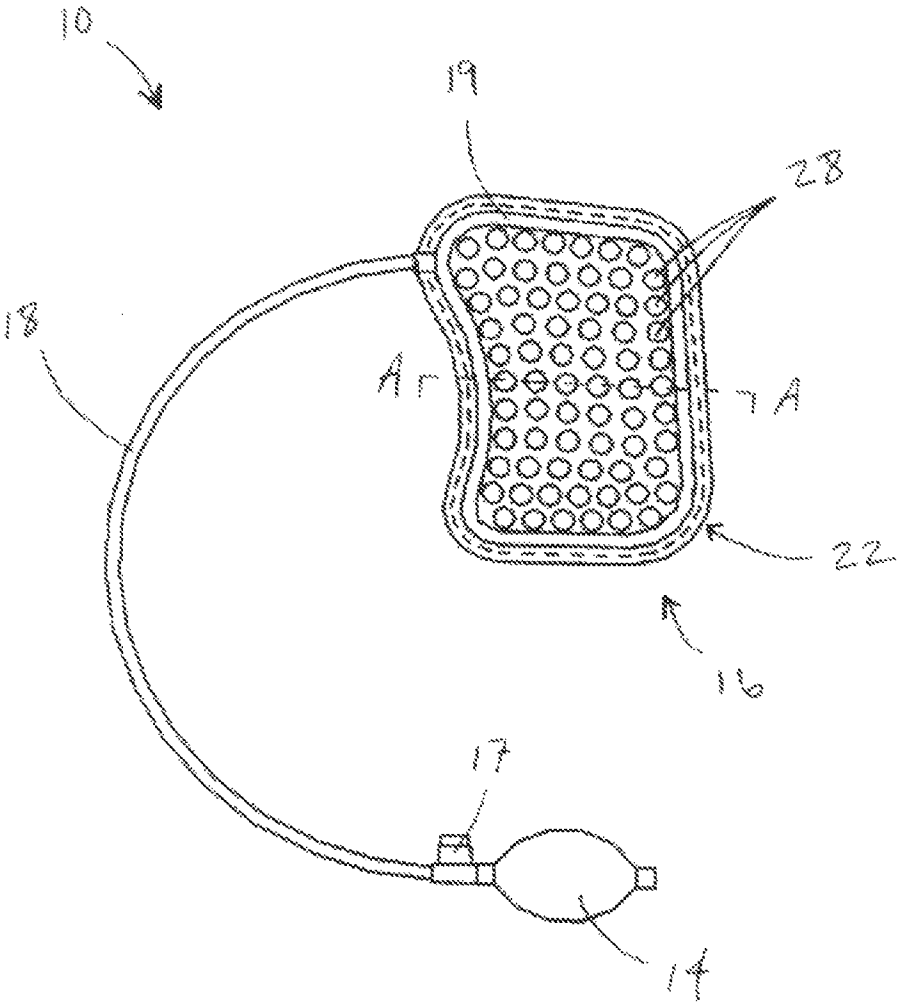
FIG. 2 is a back, perspective view of the embodiment of FIG. 1.

Referring now to the drawings, FIGS. 1 and 2 show an impact reduction device 10 in accordance with an embodiment of the present technology. The impact reduction device 10 may include a pad 16 formed of two opposing layers, including a back layer 22 and front layer 20. The pad 16 may include one or more ribs 19 to stiffen the pad at its periphery and define the shape of the pad. Furthermore, each layer 20, 22 of the pad may define dimples 28 protruding in a direction toward the opposing layer. The impact reduction device 10 may optionally include a bladder 24 (shown in FIG. 3) disposed between the first and second layers of pad 16. In addition, impact reduction device 10 may include a pump 14 connected to the bladder 24. Pump 14 may inflate or deflate the bladder 24 by way of a conduit 18 connecting the pump 14 to the bladder 24.

Figure 3:
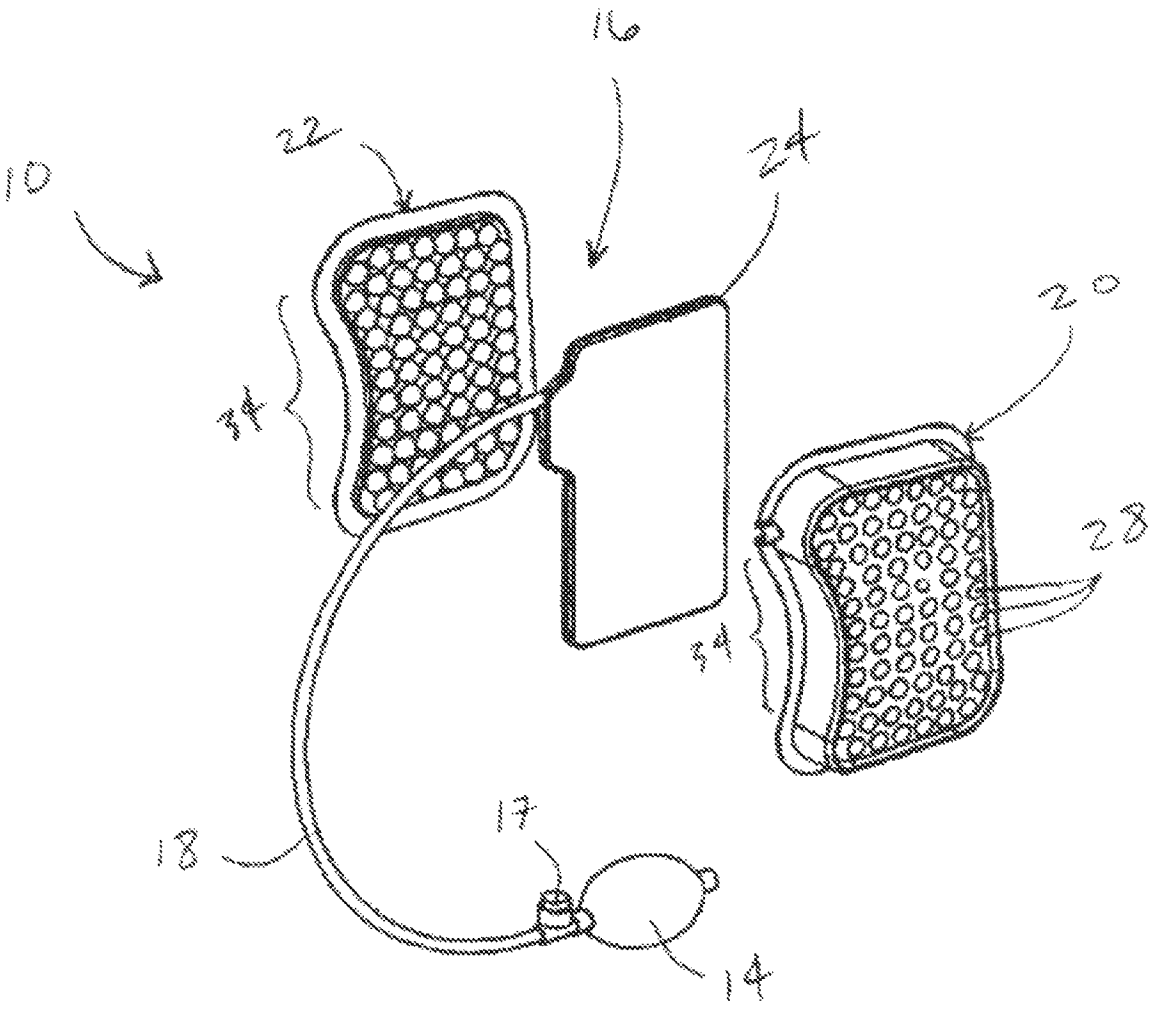
FIG. 3 is an exploded perspective view of the embodiment of FIGS. 1-2.
Figure 7:
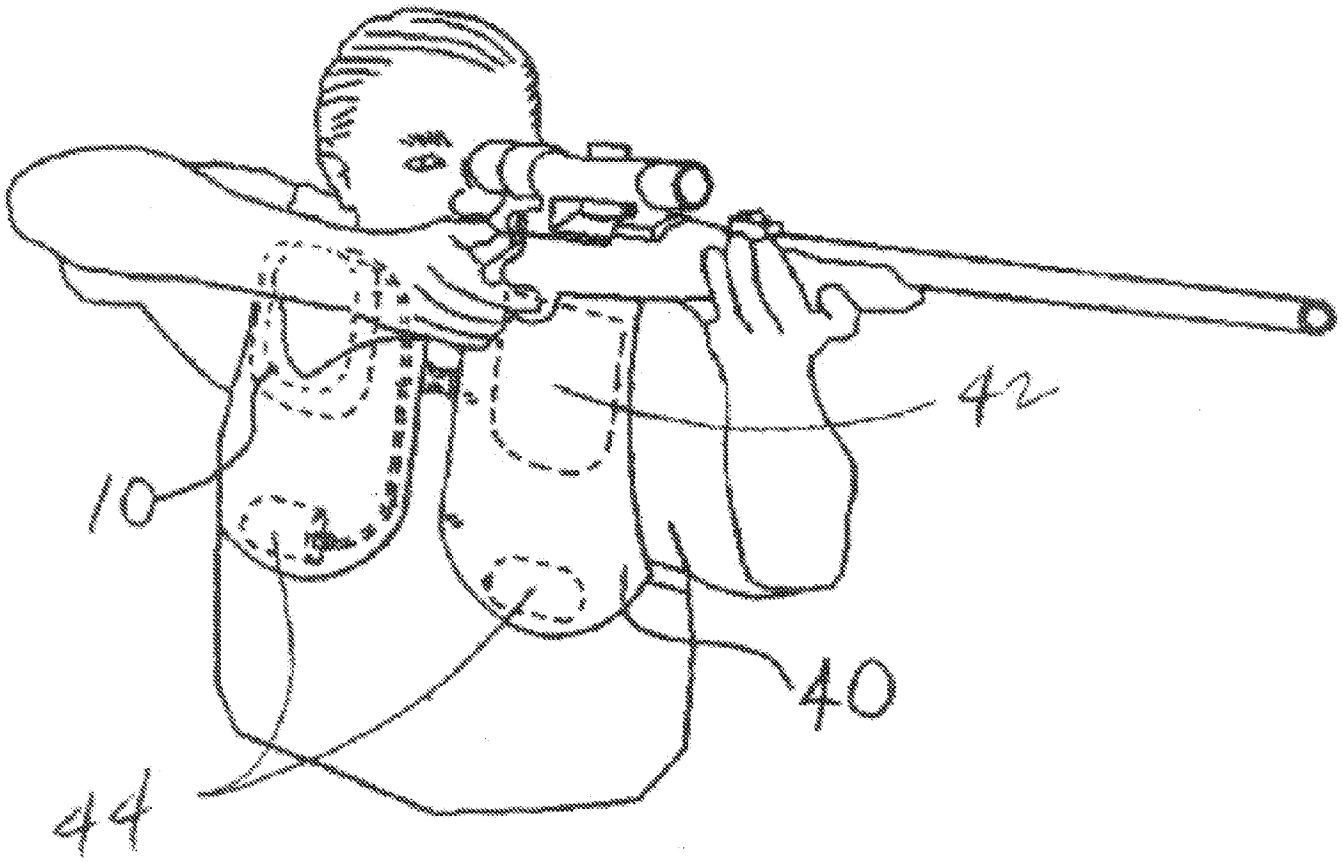
FIG. 7 shows the vest of FIG. 6 in use.
Figure 8:
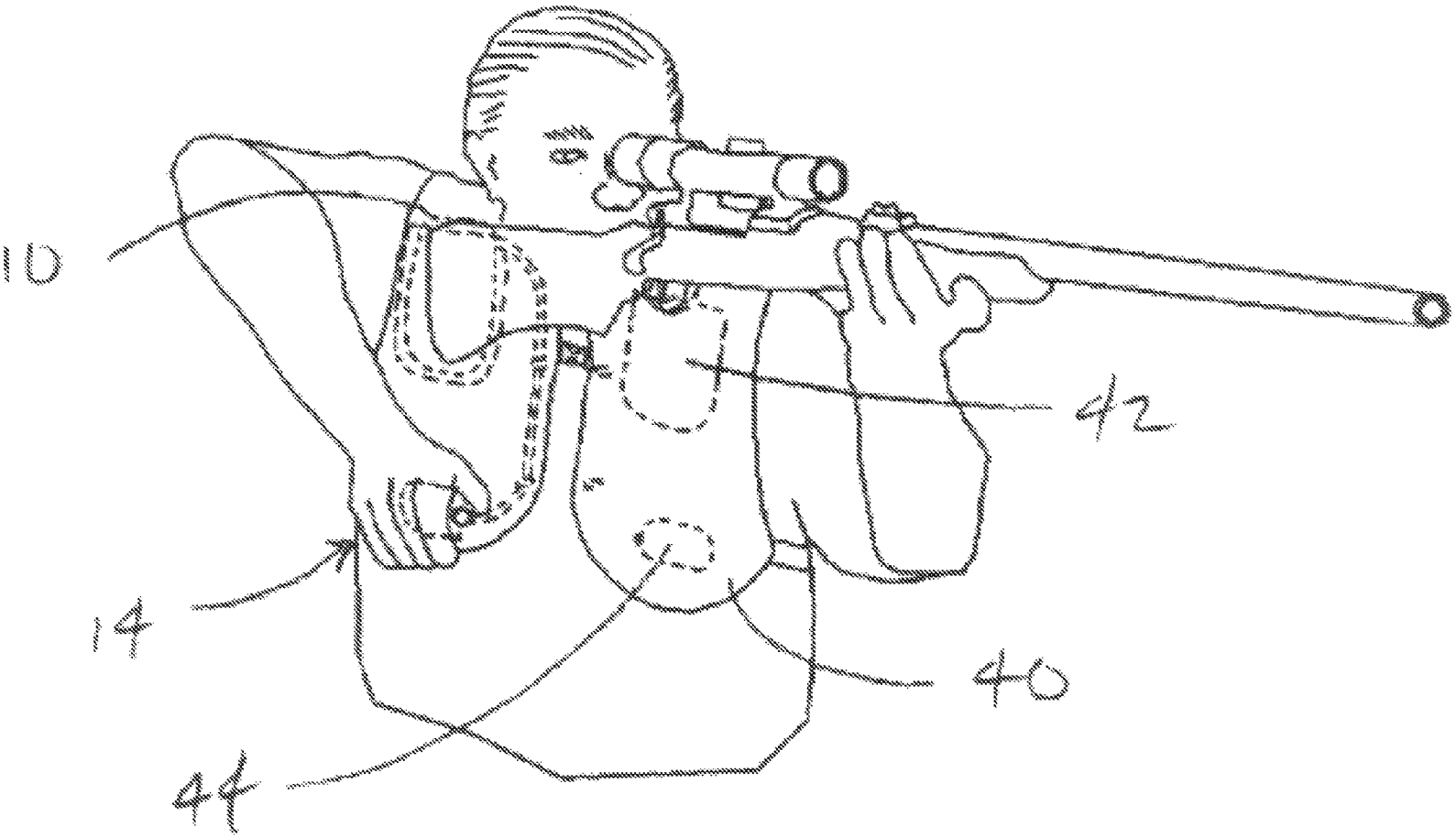
FIG. 8 shows the vest of FIG. 6, with the user adjusting the recoil suppression system by inflating the bladder connected to a manual pump.

The shape of the pad 16 will be predetermined by the intended placement of the pad on the human body. For example, in the case of a pad to protect against recoil of a rifle, the pad may likely be placed over the shoulder of a user, as shown in FIGS. 7 and 8. Thus, the pad may be shaped as shown in FIG. 3, with a curved contour 34 positioned to allow a user to turn his head and neck freely without impedance by the pad 16. Alternatively, such as where the pad will be used as an athletic pad, the pad may be shaped to conform to, for example, the head (for use in a helmet), neck, shoulder, ribs, spine, hip, thigh, knee, lower leg, upper arm, forearm, wrist, ankle, hand, and so forth. The shape of the pad may be determined by the application and the portion of the body that the pad is intended to protect.

Again referring to FIG. 3, there is shown an exploded view of the shock absorbing device 10, including layers 20 and 22 of the pad. Layer 22 may preferably be substantially flat and configured for placement proximate a user's body. In contrast, layer 20 may preferably be recessed to define an interior volume. As can be clearly seen, when layer 20 is superimposed over layer 22, the interior volume of layer 20 may receive a bladder 24, discussed below, so that when the pad 16 is assembled the bladder 24 is disposed between layers 20 and 22.

Preferably, the layers 20 and 22 may be joined at their peripheries, thereby enclosing the above-discussed void between the layers. Such an enjoinment of the layers at their peripheries may be accomplished by mechanical, thermal, or chemical means. Alternatively, the multi-layered pad 16 may be formed by a molding or other process. The edges of the molds may be heat sealed, so there is no shifting of the layers relative to each other after they are joined.

Further the layers 20 and 22 of pad 16 may be composed of low-density polyethylene materials or nanotubes. This low-density polyethylene material may have a thickness of 0.01 to 0.04 inch. Polyethylene is a desirable material for use in the present technology because upon receiving an impact force, polyethylene has the ability to compress and break down in order to absorb shock and dissipate energy. Moreover, after the impact force passes, polyethylene has the ability to return to its pre-impact state. This resilience, or memory, enables a pad made from polyethylene to be reused multiple times without losing its effectiveness as an impact reduction pad. Alternative materials, such as coiled carbon nanotubes or composite carbon nanotubes possessing similar impact reduction qualities may also be used.

Figure 4:
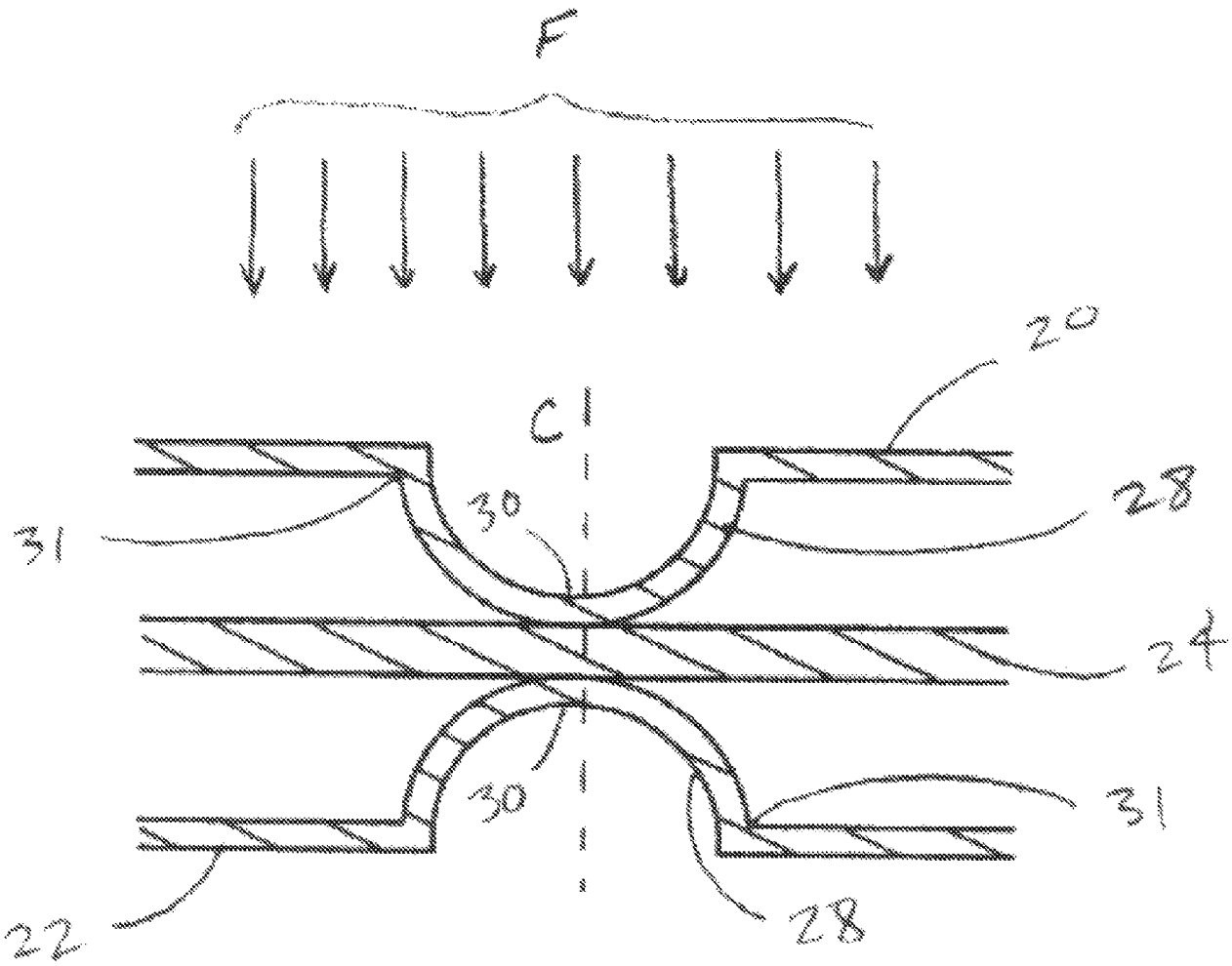
FIG. 4 is a cross sectional view of the embodiment of FIGS. 1-3 taken along line A-A of FIGS. 1 and 2.
Figure 5:
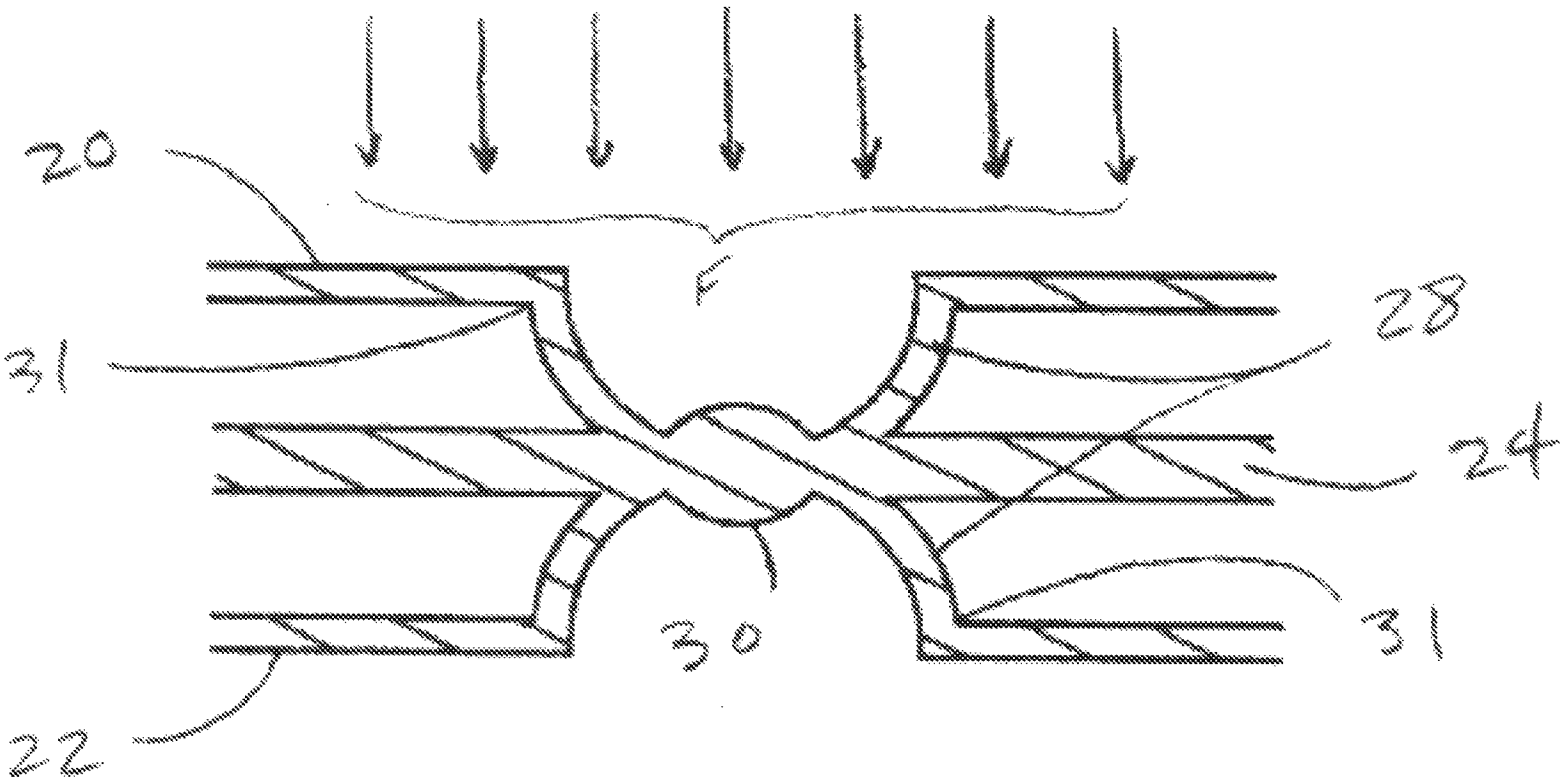
FIG. 5 is a cross sectional view of the embodiment of FIGS. 1-3 taken along line A-A of FIGS. 1 and 2 upon application of a force F to the pad.

FIGS. 4 and 5 show cross-sectional views of the dimples 28 of the pads of the present technology. FIG. 4 shows layers 20 and 22 in an assembled state with bladder 24 disposed therebetween. In the drawing, bladder 24 is shown in its deflated form. The dimples 28 of each layer may be configured to extend inwardly toward the opposing layer of the pad. The apices remain in alignment during use of the pad because the edges of the pads are joined using a heat seal, as discussed above. Each dimple 28 has an apex 30 and a base 31. As an impact force F is applied to the pad, the layers 20 and 22 of the pad are pressed together, thereby bringing the apices of opposing dimples 28 together. Force F is directed parallel to the center axis C of the dimples. As force is applied to the apex of each dimple 28, the energy exerted by force F is dissipated around the circumference to the base of each dimple. From the base, the energy is dispersed radially 360 degrees along the plane of the layer within which the dimple is formed. Thus, the energy of the impact force is directed away from the user's body along the plane defined by the surface of the pad, and the body is protected.

In addition to the above, the dimples 28 dissipate the energy of an associated impact force by collapsing. That is, at some point during application of impact force F, the magnitude of the force, and the amount of kinetic energy imposed upon the pad thereby, may be large enough to collapse or partially collapse the dimples as shown in FIG. 5. When this occurs, the energy entering the pad is further dissipated in the form of elastic energy, heat, sound, etc. Thus, the dimples 28 serve to dissipate energy and protect the user of the pad in more than one way. Furthermore, because the dimples 28 are formed of polyethylene, they are elastic and resilient, and will return to their normal shape after removal of the impact force.

As discussed above, and shown in FIG. 3, bladder 24 may be disposed between layers 20 and 22 of pad 16. The bladder 24 may preferably include walls enclosing a void, like a balloon, although it is not intended to be limited to this structure. For example, the bladder could alternatively be inflatable foam or other material capable of retaining air or other fluid and whose volume is adjustable depending on the amount of air or other fluid retained. In use, bladder 24 may substantially fill the interior volume between back layer 22 and front layer 20. Bladder 24 may be inflated with a fluid, preferably air, to a desired level. The fluid-filled bladder may then provide additional cushion or protection against impact forces by absorbing impact energy before it reaches a user's body. When the inflated bladder 24 is used along with the dimpled layers of the pad, the energy dissipation abilities of each component work together to provide a high level of protection that could not be achieved by the use of any one component by itself.

Bladder 24 may be inflated or deflated by a detachable pump 14, shown in FIGS. 1-3. The pump 14 may be a manual pump as shown in the drawings. Alternatively, the pump 14 may be powered by an outside source such as, for example, an electrical, aerosol, or pneumatic source. In the embodiment shown in FIGS. 1-3, the pump 14 is connected to the bladder 24 via a conduit 18. Conduit 18 may be any suitable conduit for carrying air or other fluids. In addition, a valve 17 may be inserted between the pump 14 and bladder 24 to maintain the fluid pressure in the bladder, to provide an indication of the pressure contained in the system, or to allow the user to relieve pressure by releasing air.

One aspect of the present technology includes the method of using the pads 16 to protect the human body from potentially injury-causing impact. In the case of marksmanship, the pads 16 of the shock-absorbing device 10 may cover the front of the shoulder of a marksman as shown in FIGS. 7 and 8. If the marksman is firing a rifle, the pads 16 may be positioned such that the butt of the rifle contacts the pads. Thus, when the rifle is fired and recoils, the impact force from the butt of the rifle enters directly into the device 10 and the kinetic energy of the impact force is dissipated by the pads and the bladder of the device.

Figure 6:
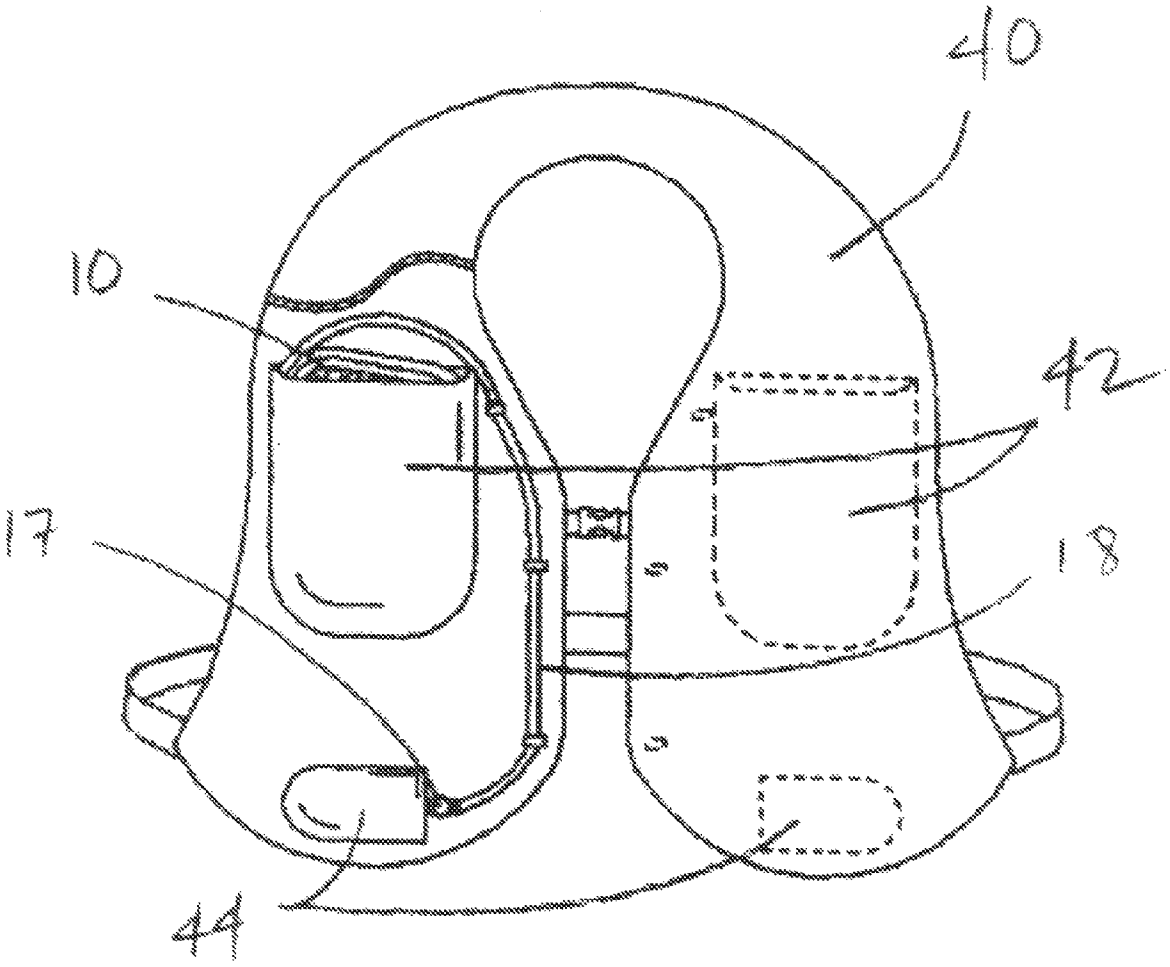
FIG. 6 is a front view of a shooting vest with an embodiment of the present invention incorporated therein for recoil suppression.

Referring to FIGS. 6-8, device 10 may be used with a vest 40 or other piece of clothing. The vest 40 may include pockets 42 and 44 for supporting the pads 16 and the pump 14 of the device 10 in a desired location. The pockets 42 and 44 may be positioned on the right or the left side of the vest 40 in order to accommodate users having differing dexterity. In addition, positioning the pump 14 of the device 10 in a lower pocket 44 of the vest 40, as shown in FIG. 8, is ergonomically conducive to adjusting the pressure in the bladder 24 by providing the user's hand easy access to the pump 14.

Figure 9:
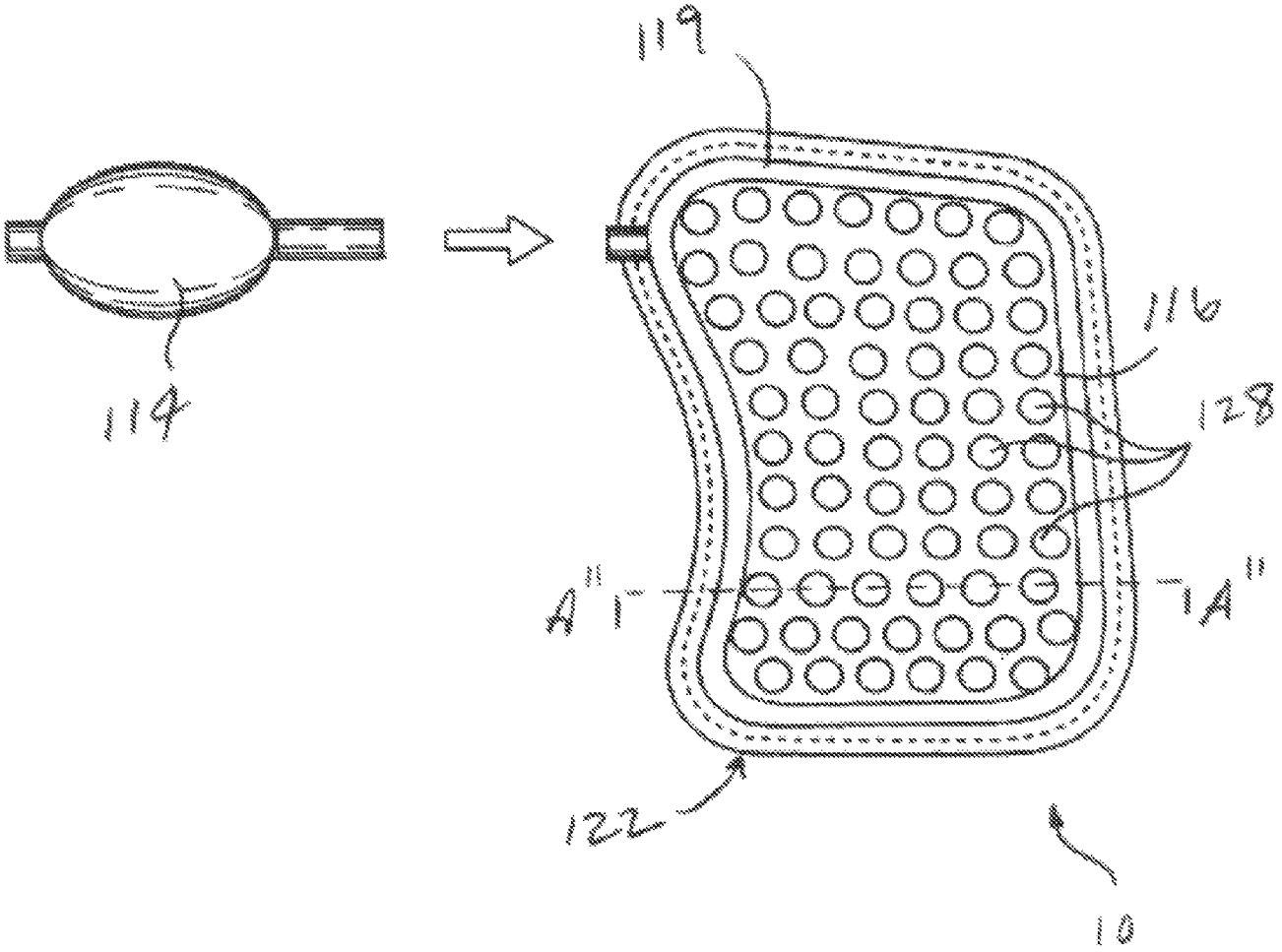
FIG. 9 is a front, perspective view of an alternative embodiment of the present invention.
Figure 10:
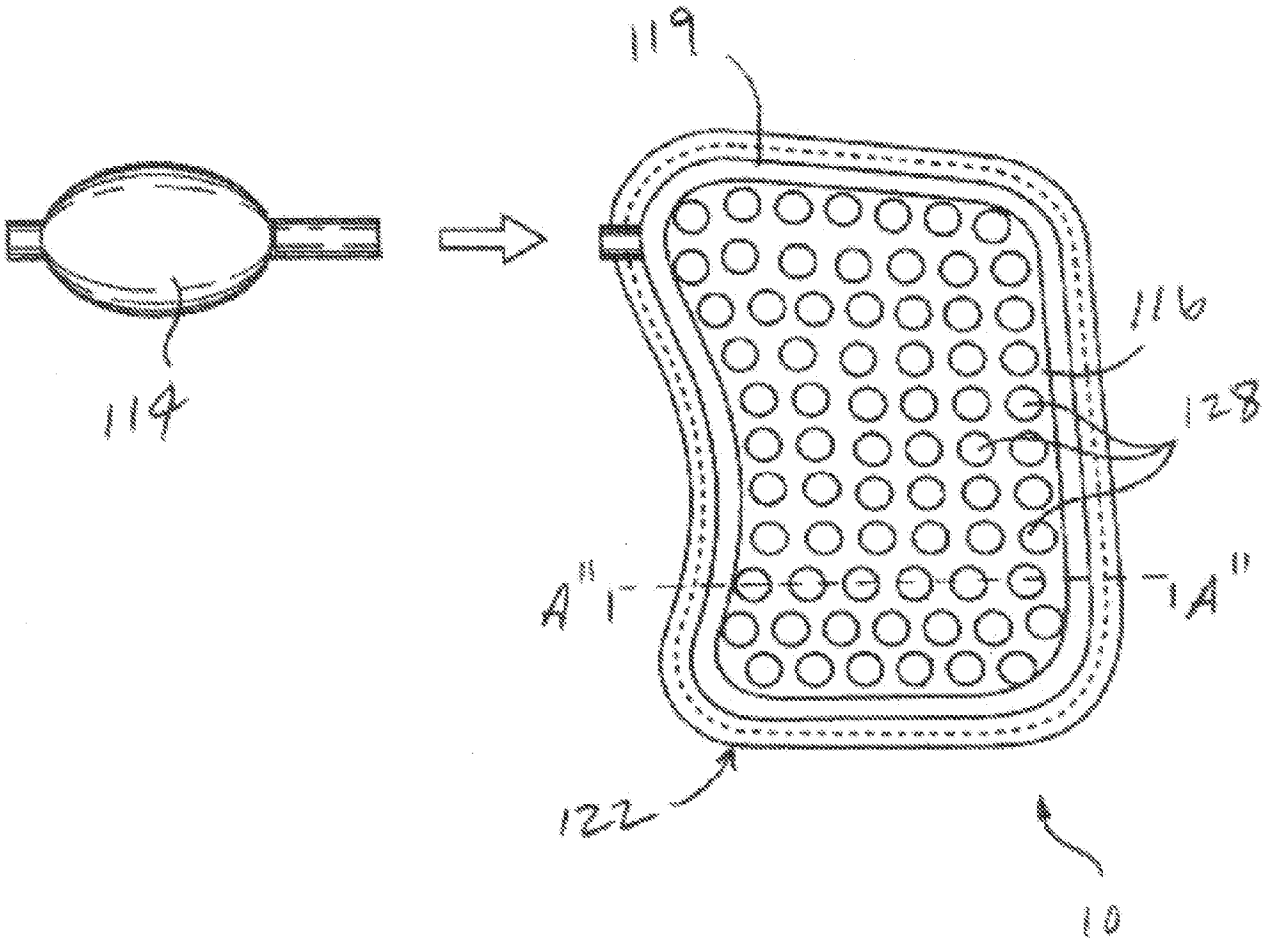
FIG. 10 is a back perspective view of an embodiment of the present invention.
Figure 11:
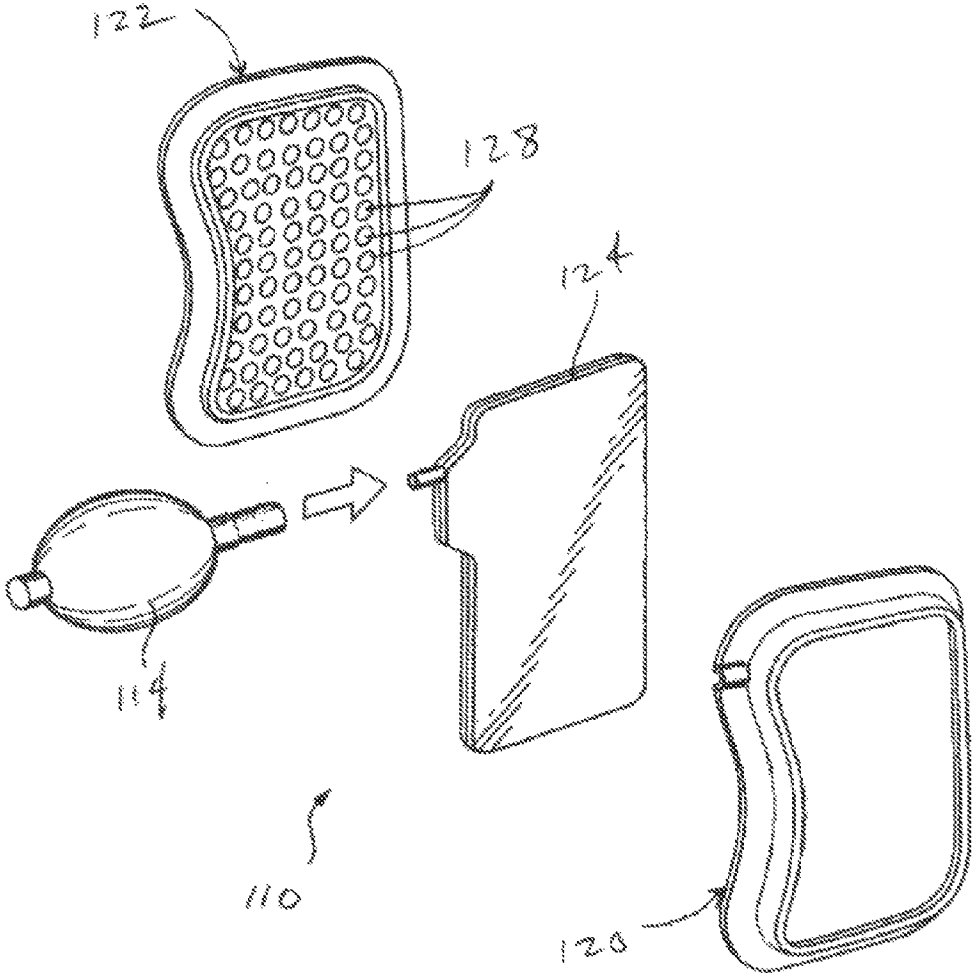
FIG. 11 is an exploded perspective view of the embodiment of FIG. 9.

Although use of the shock-absorbing device of the present technology has been discussed with regard to use in the specific application of marksmanship, another aspect of the technology provides shock-absorbing devices for use in other applications, such as contact sports, gravity game sports, and other impact sports. For example, there is shown in FIGS. 9-11 a shock-absorbing device 110 according to the present technology having a pad 116 formed of two opposing layers 120 and 122. In a preferred embodiment, the outer layer 120 may be formed of a low-density polyethylene material while the inner layer 122 may also be formed of a low-density polyethylene material. The pad 116 may include one or more ribs 119 to stiffen the pad 116 at its periphery and define the shape of the pad. Furthermore, one or more of layers 120, 122 of the pad 116 may define dimples 128 protruding in a direction toward the opposing layer. The shock-absorbing device 110 may further include a bladder 124 (shown in FIG. 11) disposed between the layers of pad 116. In addition, shock-absorbing device 110 may include a pump 114 configured for removable attachment to the bladder 124.

Figure 12:
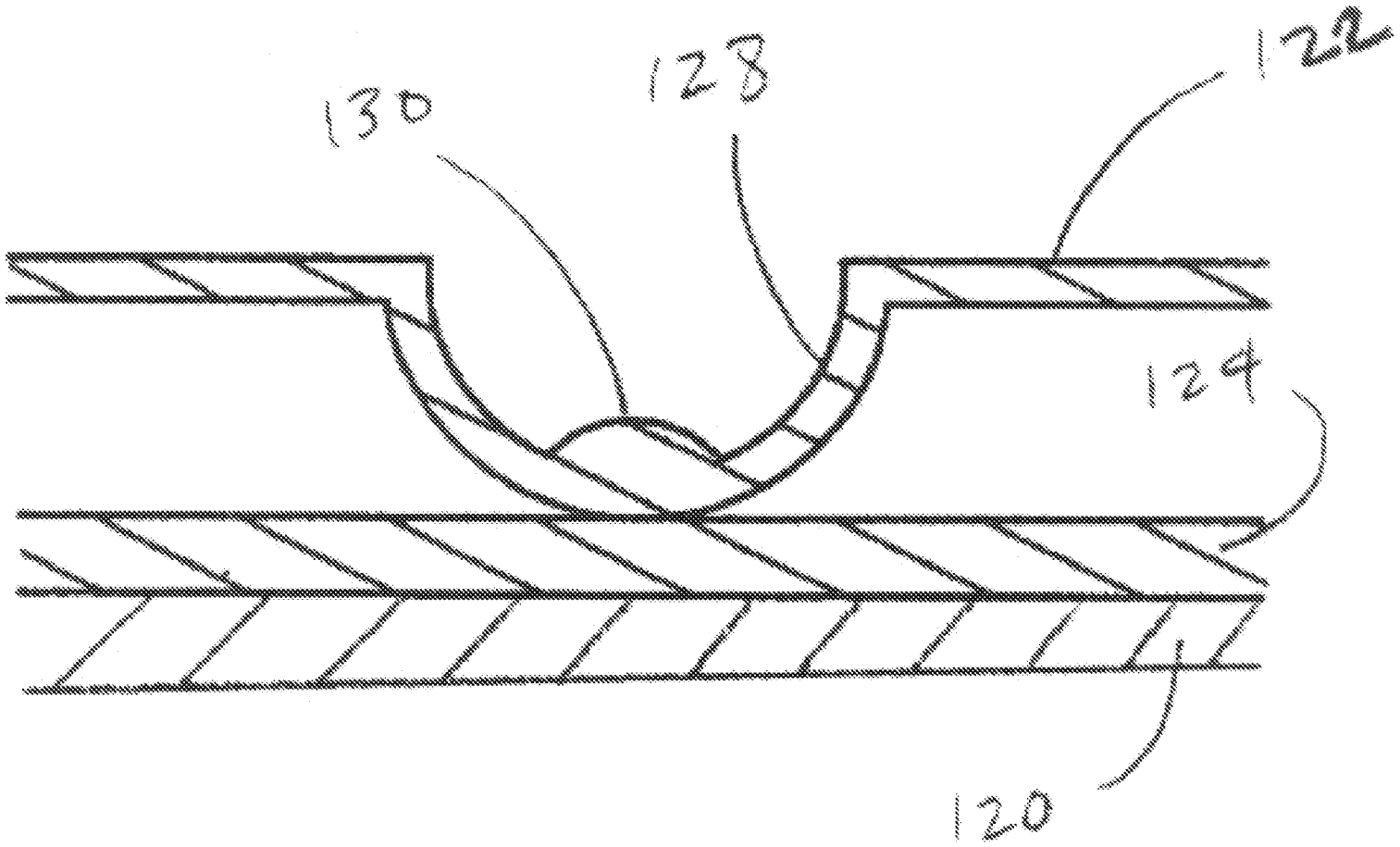
FIG. 12 is a cross-sectional view of the embodiment of FIGS. 9 and 11 taken along line A'-A' of FIG. 9.

The pad of the present embodiment is well suited for use as an athletic pad because of its thin profile. For example, in the embodiment shown in FIGS. 9 and 11, layer 122 of pad 116 defines dimples while layer 120 does not. Such an arrangement is further shown in the cross sectional view of FIG. 12. With this arrangement, the dimples 128 of layer 122 may still provide the necessary structure to aid in energy dissipation, behaving in the same way as described above, while at the same time the overall thickness of the device may be reduced. Such a reduction of thickness of the impact reduction device allows great flexibility and range of movement for an athlete using the device. Such a feature is beneficial to athletes competing, for example, in contact sports such as American football, soccer, and hockey, among others. Note that the thickness of the material in a layer such as 122 does not need to remain constant. There can also be thicker sections, such as that shown at the dimple apex 130 to further refine the response of the pad to various forces.

Figure 13:
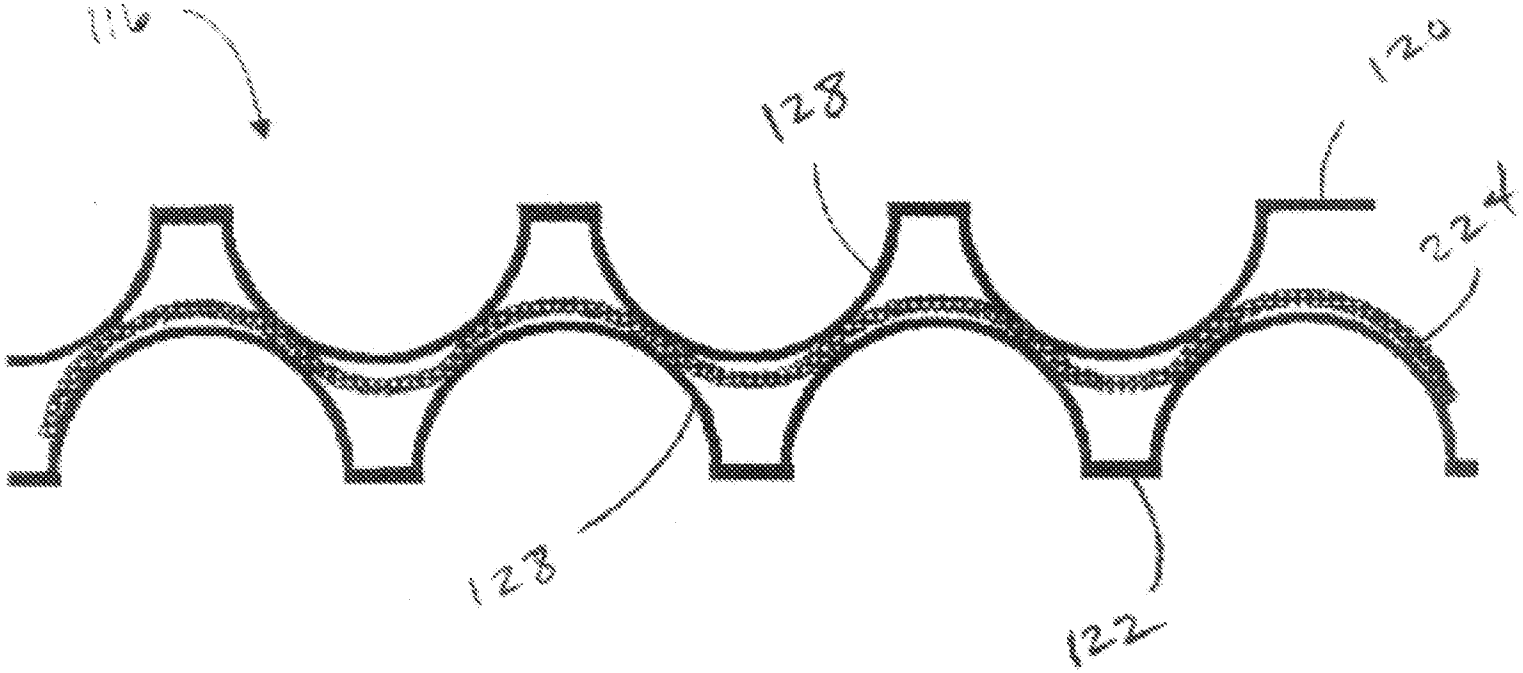
FIG. 13 is a cross-sectional view of an alternative embodiment of the present invention taken along line A"-A" of FIG. 10.

Similarly, as shown in FIG. 13, both layers 122 and 120 of pad 116 may define dimples that are offset from one another. In this arrangement the dimples 128 of layer 120 are aligned with the voids between the dimples of layer 122. Such an arrangement may provide an increased number of dimples as compared with the arrangement shown in FIGS. 9 and 11, while simultaneously maintaining a thin profile suitable for use in athletic equipment. There can also be an interposed layer 224, which can be a bladder.

As shown in FIGS. 9-11, another distinguishing feature of the present embodiment is the pump configuration. In the case of athletic pads, the pump 114 may be directly attachable to the bladder 124 without the use of a conduit. Furthermore, the pump 114 may be detachable so that when the bladder 124 has been properly inflated the pump can be removed and will not interfere with the movement of the athlete thereafter. Upon removal of the pump 114, an interior valve (not shown) within the bladder 124 will close, thereby maintaining a desired volume of air within the bladder. Air may be released from the bladder by adjusting or squeezing the valve in such a way to open the valve to the flow of air.

Figure 14A:
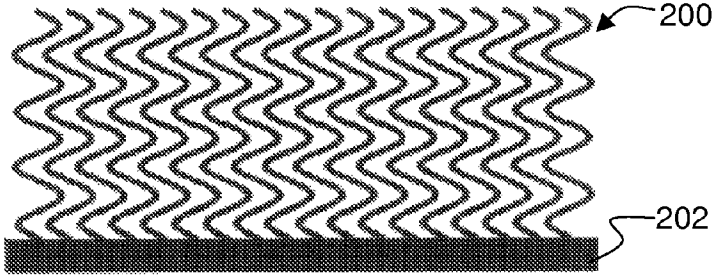
FIGS. 14*a*-14*d* are schematic diagrams of arrangements of the nanotubes of embodiments of the present invention.
Figure 14B:
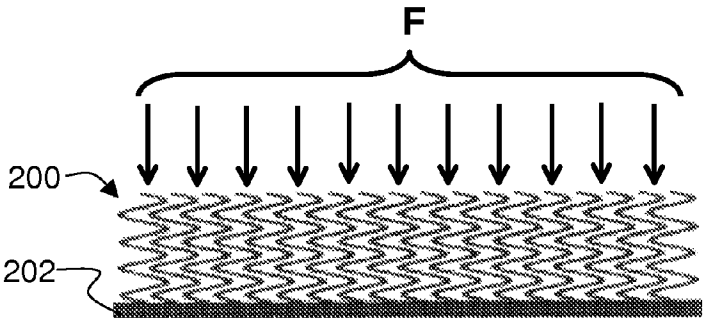
Figure 14C:
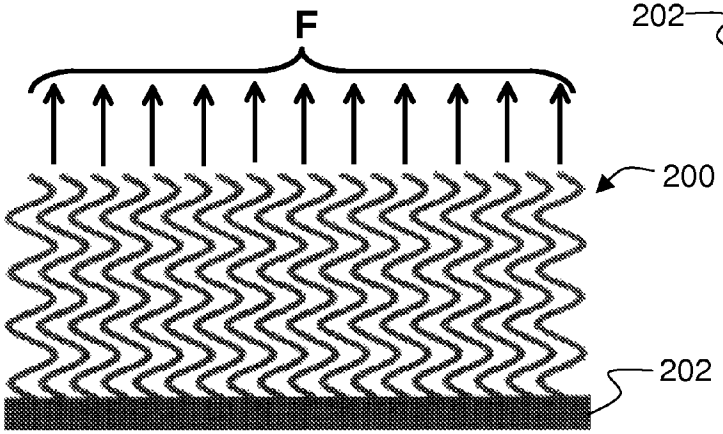
Figure 14D:
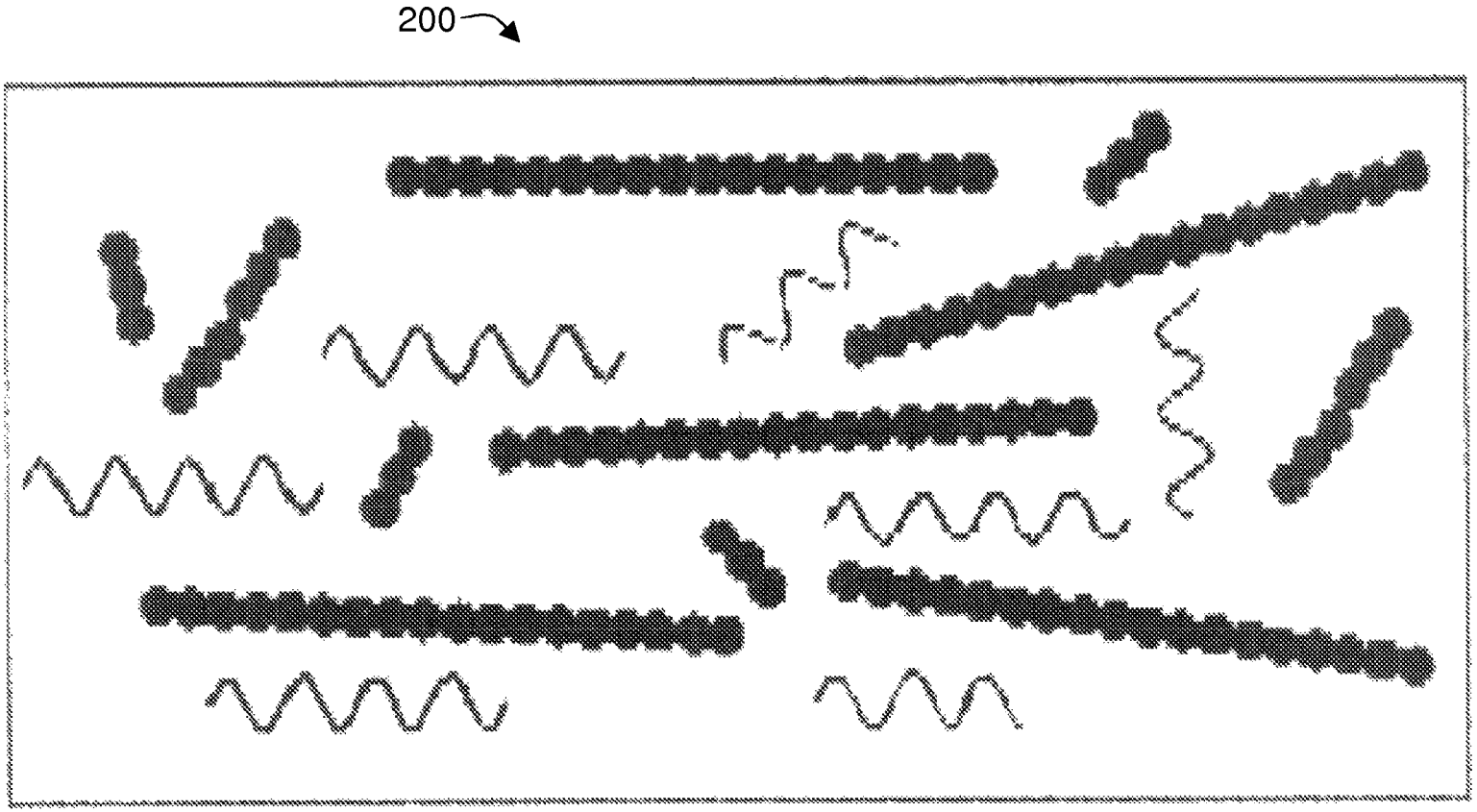

Referring to FIGS. **14*a*-14*d*, there is shown a forest of carbon nanotubes 200 as may be used in an embodiment of the present technology. The nanotubes (i.e. nanometer-scale carbon material in which the individual carbon atoms are bonded together in a tubular configuration) may be coiled carbon nanotubes, shown in FIGS. 14*a*-14*c*, or composite carbon nanotubes, as shown in FIG. 14*d*, and may be attached to at least a portion of the impact reduction device to further enhance the shock absorbing capabilities of the device. Similar to the polyethylene described above, these nanotubes have the ability to lessen the impact to the human body by compressing upon application of a force F, as shown in FIG. 14***b*, and then resuming their pre-impact shape after the force is removed, as shown in FIG. 14*c*. A thin layer of the nanotube material may cover one or both sides of the polyethylene material 202 to enhance the impact absorption capabilities thereof. Alternatively, the nanotube material may replace the polyethylene material. Furthermore, the nanotube material may be layered over the bladder to prevent puncture. Other materials that may be used in embodiments of the present invention can include:

silicone carbide;
boron carbide;
amorphous boron;
hafnium carbine;
tantalum carbide;
tungsten carbide;
magnesium diboride;
glassy carbon;
diamond-like carbon;
single-crystal tungsten;
boron nitride;
titanium diboride;
hafnium diboride;
lanthanum hexaboride;
cerium hexaboride;
molybdenum carbide;
tungsten disulfide;
polyurethane;
polyvinyl;
nylon;
an aramid material such as kevlar;
or any organic or inorganic material.

Figure 15:
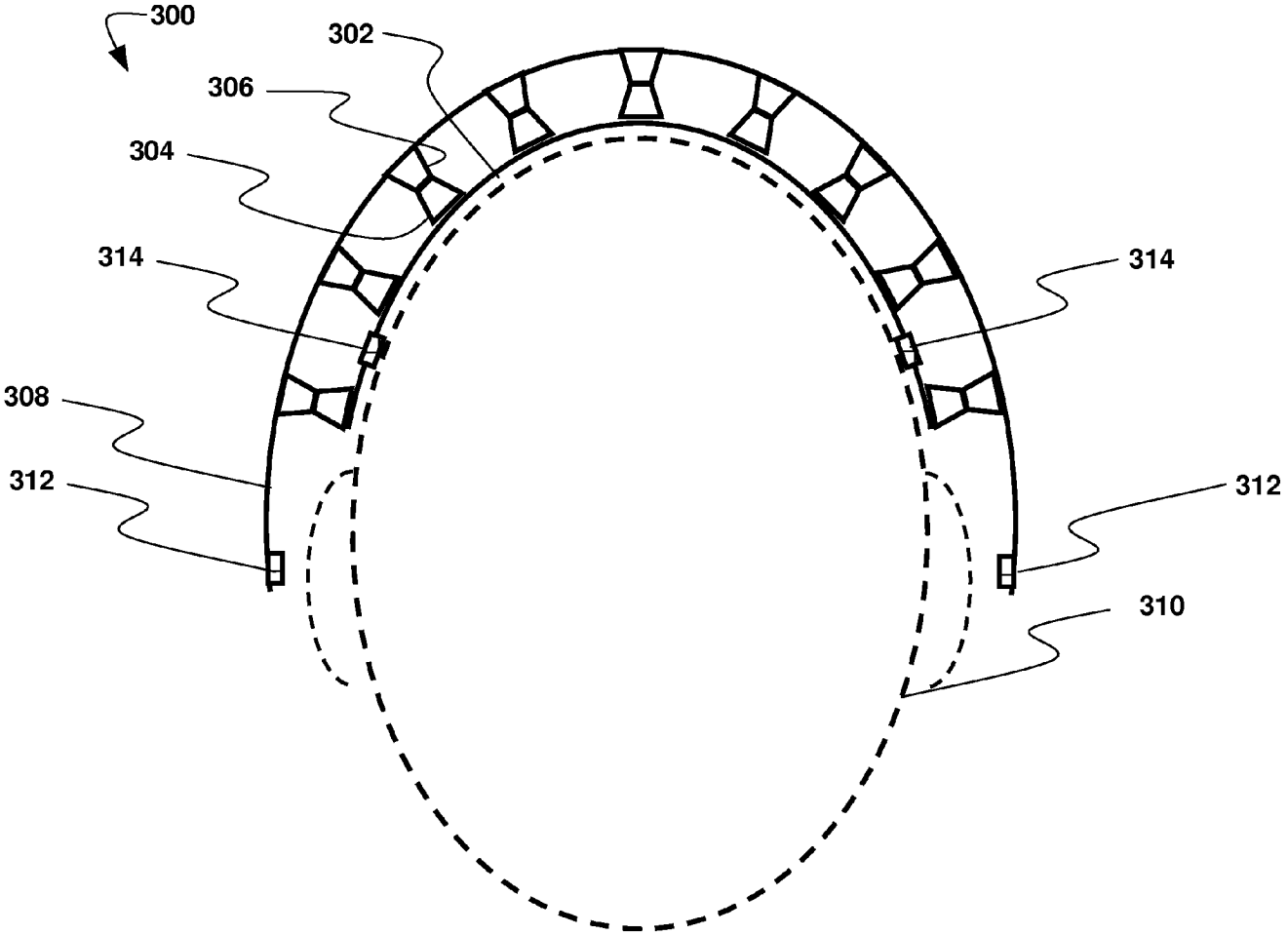
FIG. 15 is a cross-sectional view of a four-layer impact reduction system configured as a helmet.

Referring to FIG. 15, a cross-sectional view of a four-layer impact reduction system configured as a helmet, is shown at 300. In this embodiment, the helmet-shaped pad 300 is located on a person's head, shown at 310. The helmet-shaped pad is composed of: a body-conforming layer 302 located closest to the person's body; an impact distribution layer 308 located furthest from the person's body; and two layers of elastically resilient impressions, shown at 304 and 306, which are located between the body-conforming layer 302 and the impact-distribution layer 308. In this configuration, the two layers with elastically resilient impressions, 304 and 306, are similar in structure, materials, and characteristics as layer 20 and layer 22 that were shown in FIGS. 1, 2, 3, 4, and 5 and layer 120 and 122 that were shown in FIGS. 9, 10, 11, 12, and 13. These layers with elastically resilient impressions could also be made of carbon fiber or nanometer-scale carbon nanotubes as illustrated at 200 in FIGS. 14*a*, 14*b*, 14*c*, and 14*d*. The body conforming layer 302 is equivalent to the inner layer of the pocket 42 shown in FIGS. 6, 7, and 8. The impact reduction layer 308 is equivalent to the outer layer of the pocket 42 shown in FIGS. 6, 7, and 8, but has one additional distinguishing characteristic in that that the impact distribution layer 308 is more rigid than the body conforming layer to help distribute an external impact over an area.

Further referring to FIG. 15, the configuration of the impact reduction system shown includes motion sensors 312 and physiologic biosensors 314. In the embodiment shown in FIG. 15, the motion sensors shown at 312 are attached to the impact-distribution layer 308. The physiologic biosensors shown at 314 are proximate to the wearer's body 310. These sensors 312 and 314 could also be attached to the wearer's body 310. The sensors 312 and 314 could be shielded from the wearer's body for safety reasons. The motion sensors 312 in embodiments of the present invention can be used to detect a variety of parameters related to position, motion, acceleration, or relative position, relative motion, or relative acceleration, examples of which can include:

detecting a rotational or angular acceleration or deceleration, which might be useful in determining characteristics such as, the timing of an impact, the magnitude of an impact, the direction of an impact, or the effectiveness of the impact reduction system in reducing the severity of the impact;
detecting an orientation, which might be useful in determining a characteristic such as the angle of an impact or the position of a person's body part at the time of an impact, or detecting a person who might be falling and likely the impact the ground, a floor, or another object during their fall;
detecting a velocity, which might useful in determining a characteristics such as the velocity at which an impact occurred or will occur;
detecting the location or position of a the wearer of a pad, which can help determine the likely location of the impact both in a local sense and in a global positioning sense (using the sensor to receive GPS/global positioning system information);
detecting a parameter of another object in the vicinity, an example might be detecting the location, velocity, and identity of other impact pads being worn by other persons in the vicinity, which might be useful in identifying an impending impact;
detecting a signal from another object in the vicinity, an example might be detecting an alarm signal coming from a device on another soldier in the vicinity or transmitting an alarm signal to another solider in the vicinity, or requesting some other kind of remote assistance;
detecting other sensors such as those on other objects in the vicinity.

The physiologic biosensors 314 can be used to detect a variety of parameters related to the physiological or biological characteristics of the person wearing the pad, examples physiologic bioparameters can include:

blood chemistry values such as alcohol level, electrolyte abnormalities, glucose level, hydration or dehydration, pH, and oxygen saturation;
blood pressure;
body temperature;
blood volume values;
calorie consumption;
electro-cardio activity;
heart rate;
hematocrit;
hemoglobin;
infrared thermal imaging;
neural activity including brain activity;
percent oxygenation;
respiratory acidosis;
respiratory rate;
rhythm disturbance; and
vital signs.

Embodiments of the present invention can also use environmental sensors that measure parameters such as air pressure, temperature, wind velocity, etc. The sensors used in embodiments of the present invention can be internally embedded (to monitor internal pressure within the padding or impacts) as well as externally embedded, and adjacent to the skin (to measure the impact received closest to the body). Sensors can be of the physiologic type or motion type and data measured can be logged and transmitted wirelessly to the wearer or remotely with auditory signals, visual signals and haptic signals. The sensors can be responsive to thresholds or presets. The sensors can be configured to allow active tracking in real time and can be used to record data for later retrieval and analysis.

The sensors shown in FIG. 15 can be connected to a controller that further includes a microprocessor as part of a smart impact reduction system. This processor or microprocessor can include a memory element to store sensor data. This stored sensor data can be used for data logging, which can facilitate evidence-driven management of the sensing and data collection process, whereby data derived from the sensors could be used to repair, modify, or alter the responsiveness of a sensor or to alter the responsiveness of a sensor and/or alter the data being recorded from a sensor or to alter the frequency at which data is being recorded from a sensor. The sensor data can also be transmitted and this transmission can be in the form of a wireless protocol such as WiFi, Bluetooth, Zigbee (and related IEEE 802.15.4 and XBee), a cellphone signal, or any other wireless protocol capable of being understood by someone skilled in the art. Sensor data can also be used to produce an alarm signal capable of being understood by a human, examples of which might include an audio alarm, a visual flashing red light, or a vibration or other tactile signal. The sensors 312 and 314 can be powered by a battery, by a generator, or by an external power source that sends its power over a wired or wireless method. The sensors can be self-adjusting or active sensors that learn from data being received to better tune themselves to signals and discriminate these useful signals from other signals and background noise.

The sensors 312 and 314 shown in FIG. 15 can also be connected to an impact mitigation device such as an air bag. This air bag could be located outside of the impact-distribution layer 308. Thus, an impact-detecting or impact-anticipating sensor could issue a signal to the airbag system that causes the airbag to deploy, cushioning the impact and thereby reducing the magnitude of the impact and bodily damage to the person wearing the impact reduction system.

Figure 16B:
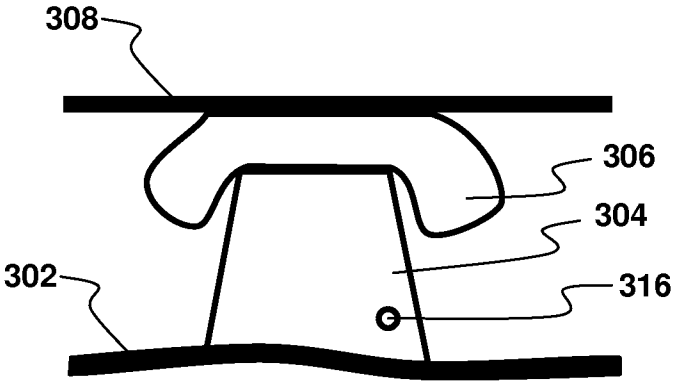
FIG. 16*a*-16*c* are detailed views of two dimple layers in a serial configuration interacting with each other.
Figure 16C:
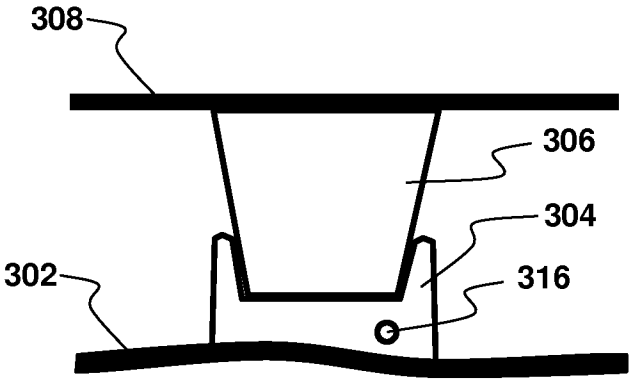
Figure 16A:
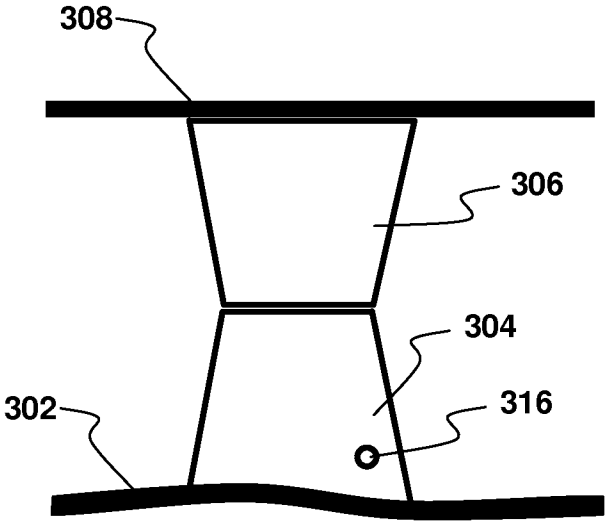

Referring to FIGS. 16*a*, 16*b*, and 16*c*, detailed views of elements of an embodiment of the four-layer impact reduction system of FIG. 15 is shown, including the body conforming layer 302, an elastically-resilient impression in a second layer 304, an elastically-resilient impression in a third layer 306, and an impact distribution layer 308. In the embodiments shown in FIGS. 16*a*, 16*b*, and 16*c*, the two layers with dimples 304 and 306 are in a series relationship (i.e. an aligned contact) in that the same force that passes through the second layer 304 is transmitted to the third layer 306 and the total compression is the sum of the compression of the second layer 304 and the compression of the third layer 306. In the embodiment shown in FIGS. 16*a*, 16*b*, and 16*c* the dimple in the third layer 306 comprises a sealed air chamber and the dimple in the second layer 304 comprises an orifice 316 that allows air (or any other gas or liquid) to bleed out of the dimple, providing a damping or "shock absorber" feature whose resistance to compression (or tension) is velocity sensitive. Note that the sealed air chamber shown in the third layer 306 could be implemented in a variety of ways examples of which include using a permanently sealed chamber, using a bladder that can be filled or emptied as desired through a closeable valve, and/or using a closed cell foam. Note also that the elements with damping in them can have a single orifice 316 or multiple orifices, and at an extreme the damping could comprise an open-cell foam. FIG. 16*a* shows the system in a relaxed state in which there is no force compressing the impact distribution layer 308 towards the body conforming layer 302. FIG. 16*b* shows an exaggerated example what happens as a result of a high speed acceleration of the distribution layer 308 towards the body conforming layer as the bulk of the deflection is taken by the sealed dimple of the third layer 306 because there is not enough time to bleed the air through the orifice 316 in the dimple in the second layer 304. FIG. 16*c* shows an exaggerated exampled of what happens as a result of a low speed acceleration of the distribution layer 308 towards the body conforming layer 302 as the bulk of the deflection is taken by the unsealed dimple of the second layer 304 because there is time to bleed the air through the orifice 316, and the sealed dimple in the third layer is altered less because the bulk of the deflection occurs as a result of air bleeding through the orifice 316 from the dimple in the second layer 304.

Figure 17B:
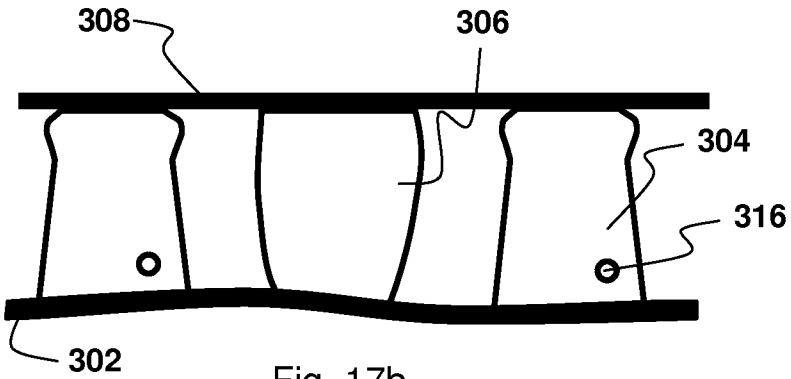
FIG. 17*a*-17*c* are detailed views of two dimple layers in a parallel configuration interacting with each other.
Figure 17C:
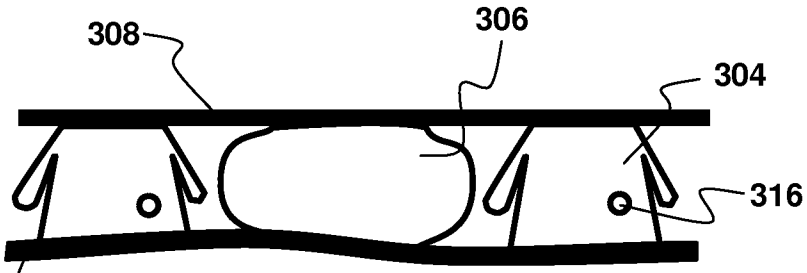
Figure 17A:
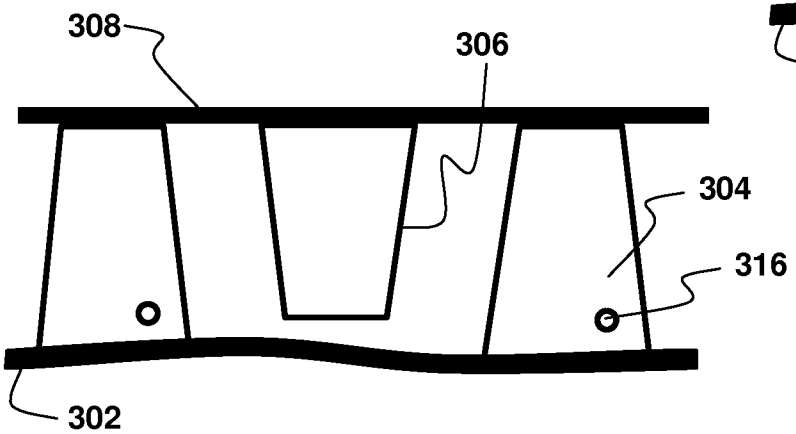

Referring to FIGS. 17*a*, 17*b*, and 17*c*, detailed views of elements of an embodiment of the four-layer impact reduction system of FIG. 15 is shown, including the body conforming layer 302, two elastically-resilient impressions in a second layer 304, an elastically-resilient impression in a third layer 306, and an impact distribution layer 308. In the embodiments shown in FIGS. 17*a*, 17*b*, and 17*c*, the two layers with dimples 304 and 306 are in a parallel relationship (i.e. an offset contact) in that an equivalent deflection occurs for the second layer 304 and third layer and the total compressive force being transmitted is the sum of the force in the second layer 304 and the force in the third layer 306. In the embodiment shown in FIGS. 17*a*, 17*b*, and 17*c* the dimple in the third layer 306 comprises a sealed air chamber and the dimples in the second layer 304 comprise orifices 316 that allow air to bleed out of the dimples, providing a damping feature. FIG. 17*a* shows the system in a relaxed state in which there is no force compressing the impact distribution layer 308 towards the body conforming layer 302. FIG. 17*b* shows an exaggerated example what happens as a result of a high speed acceleration of the distribution layer 308 towards the body conforming layer as the bulk of the compression is resisted by the dimples in the second layer 304 because there is not enough time to bleed the air through the orifices 316. FIG. 17*c* shows an exaggerated example of what happens as a result of a low speed acceleration of the distribution layer 308 towards the body conforming layer 302 as the bulk of the compressive force is resisted by the sealed dimple of the third layer 306 because there is time to bleed the air through the orifices 316 of the dimples in the second layer 304.

Further referring to FIGS. 15-17*c*, the second layer 304 and third layer 306 can be designed to have different resistance to deflection in a direction perpendicular to the surfaces of the body conforming layer 302 and the impact distribution layer 308 than their resistance to deflection parallel to the surfaces of the body conforming layer 302 and impact distribution layer 308, whereby the rotational resistance of the helmet shown as 300 in FIG. 15 might be different than the resistance to impacts perpendicular to the shell of the helmet 308 in FIG. 15. Note also that the force deflection characteristics can be different for different dimples in the system. Thus, the impact reduction system can comprise dimples that have force-displacement relationships that vary:

as a function of direction;

as a function of speed;

as a function of position;

as a function of location; and/or as a function of rotation versus translation.

Figure 18B:
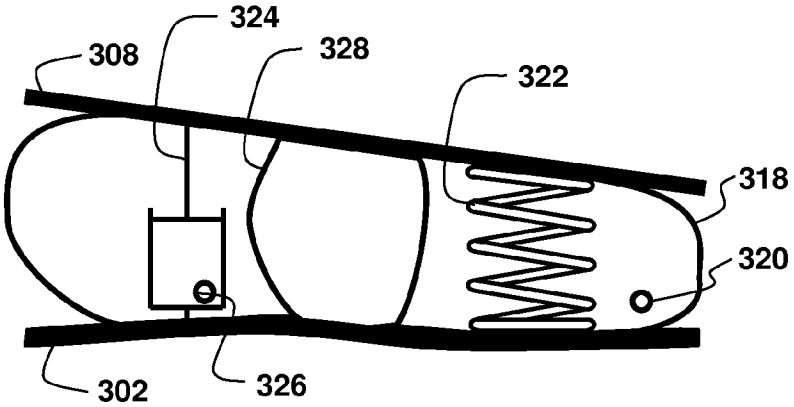
FIG. 18*b* is a view of the pad of FIG. 18*a* when quickly compressed.
Figure 18C:
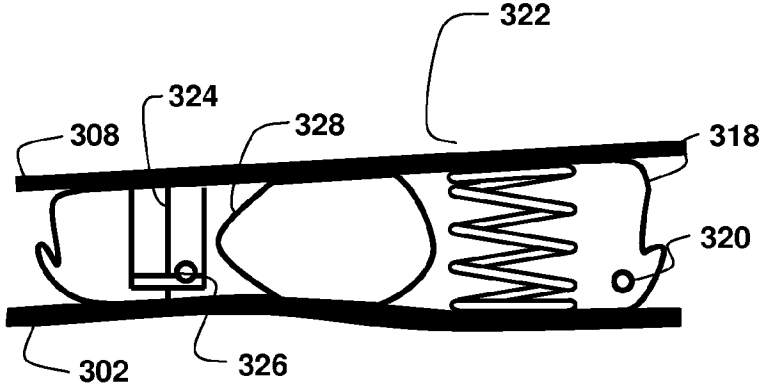
FIG. 18*c* is a view of the pad of FIG. 18*a* when slowly compressed.
Figure 18A:
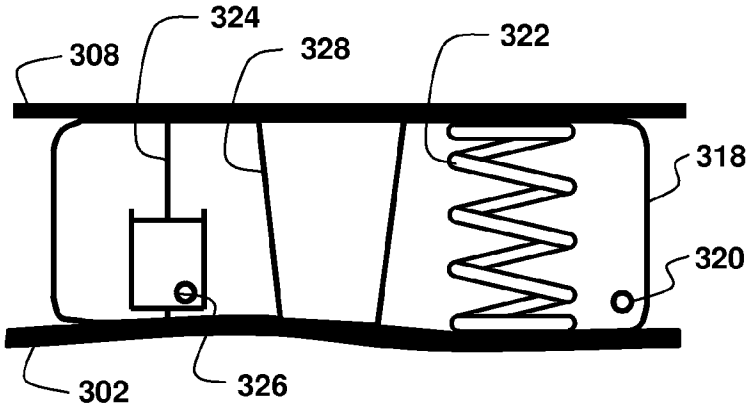
FIG. 18*a* is detailed view of a three-layer pad having an interposing compound bladder in its relaxed state.

Referring to FIGS. 18*a*, 18*b*, and 18*c*, detailed views of elements of another embodiment of the four-layer impact reduction system of FIG. 15 is shown, including the body conforming layer 302, an impact distribution layer, shown at 308, and an interposing layer which includes a compound bladder, shown at 318. The compound bladder 318 could be an inflatable bladder, it could be a sealed bladder, it could be self-inflating and deflating bladder that further comprises a compound bladder orifice, shown at 320, which allows air pressures to equalize between the interior and exterior of the compound bladder 318, or it could be any other kind of bladder capable of being understood by anyone skilled in the art. The compound bladder 318, could further comprise internal elements such as a mechanical spring, shown at 322, a piston-based damper shown at 324 having a piston orifice at 326, or an internal dimple shown at 328, or any other force-displacement element described in this disclosure or capable of being understood by anyone skilled in the art. These internal mechanical spring systems, piston-based dampers, internal air bladders can be tunable. It should further be understood that there could be any number of elements incorporated into the compound bladder 318 and these elements could be in any configuration including any series configuration, any parallel configuration, or any combination of series and parallel configurations. For example, the internal dimple, shown at 328 could be replaced by a series combination of an elastically resilient impression, shown at 306 in FIG. 16*a*, and an elastically resilient impression with a dimple, shown at 304 and 316 in FIG. 16*a*. FIG. 18*b* shows an exaggerated example what happens as a result of a high-speed acceleration of the distribution layer 308 towards the body conforming layer 302. In this situation, the spring 322 and the dimple 328 move further than the external bladder 318 and the piston damper 324, which take time to equalize. FIG. 18*c* shows an exaggerated exampled of what happens as a result of a low speed acceleration of the distribution layer 308 towards the body conforming layer 302. In this situation, the external bladder 320 and the piston damper 324 move further than the spring 322 and the dimple 328 whose response are not impact rate dependent.

Figure 19:
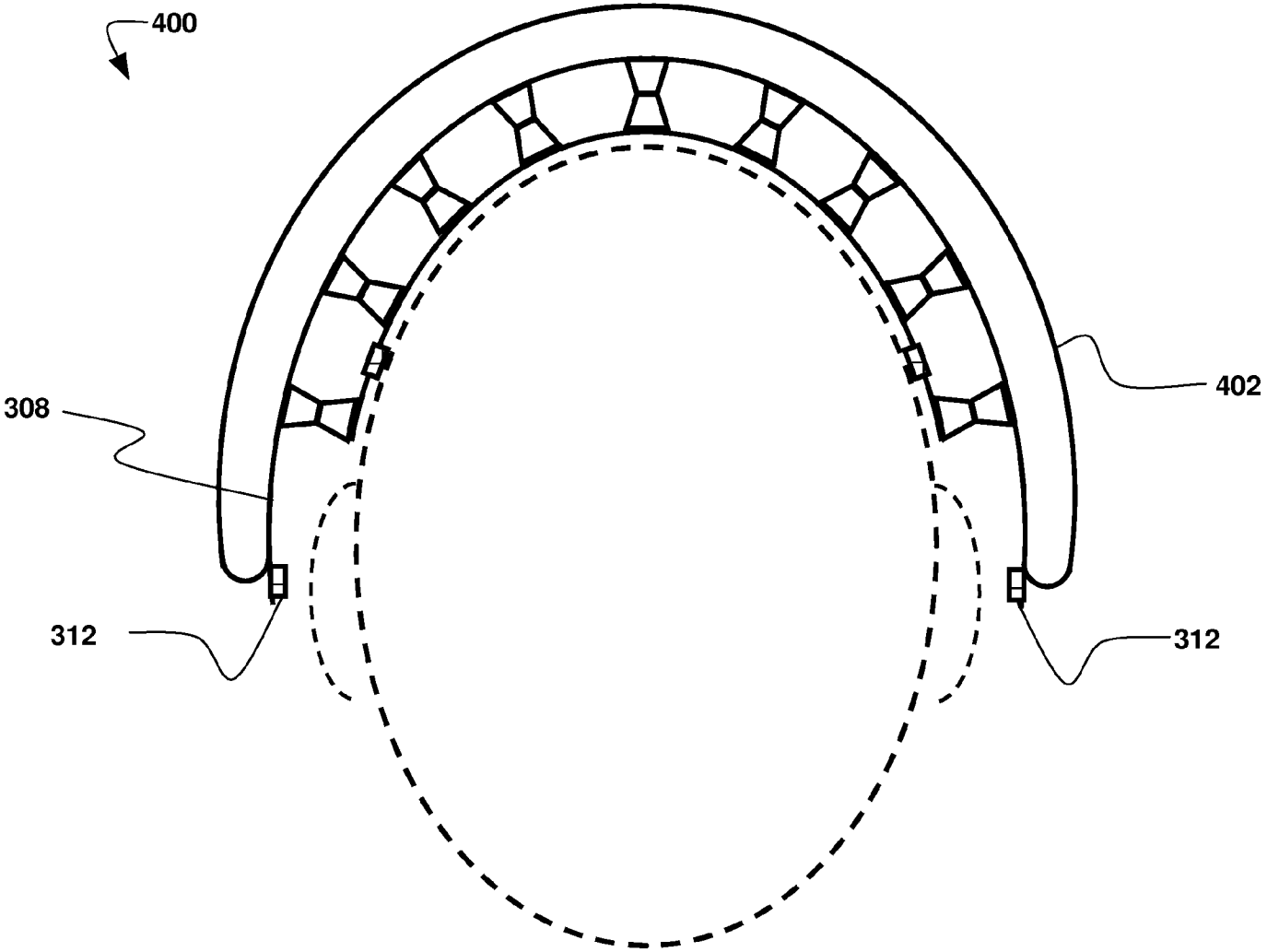
FIG. 19 shows an embodiment of the system of FIG. 15 further comprising an inflatable external element.

FIG. 19, shows a cross-sectional view of an alternate embodiment of the impact system that was shown in FIG. 15. In this alternate embodiment, the helmet-shaped pad 400 further comprises an inflatable external element, shown at 402. This external inflatable element 402 can be an air bag that is rests against the hard shell 308 when not in use. The inflatable element 402 could inflate in response to one or more sensors 312 that detect a reason for providing additional cushioning. Reasons for additional cushioning might include detection of an incoming collision, detection of a fall, or detection of any other event which might cause injury to the region being padded. The external inflatable element 402 could be a single element or it could be multiple elements that are independently actuated. The external inflatable element 402 or elements could be inflated using a cartridge with a compressed gas, such as the $CO_2$ cartridges used in automotive airbags or any other source capable of being understood by anyone skilled in the art, including refillable or rechargeable gas sources to provide a multi-use air bag. Such a system could be used in combination with active sensors, to inflate and deflate the pad. A sensor in the system, such as one embedded in the impact padding can identify the impeding impact by measuring the distance and velocity of the oncoming object or person and expand before the impact. There can be multiple inflatable components, which may inflate at different times. Micro-pumps, micro-canisters or rechargeable systems can be used to inflate, re-inflate the air containing compartment or portion of the pad.

Figure 20C:
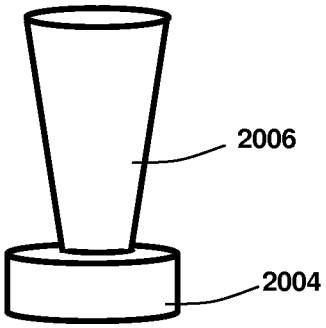
FIG. 20*c* is an isometric view of a conforming pad and a shock absorption element in series.
Figure 20D:
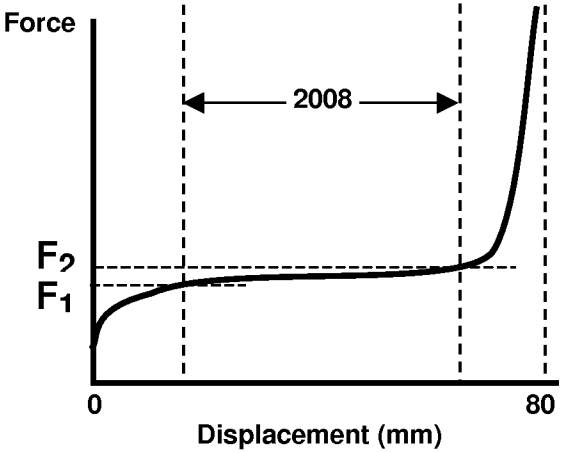
FIG. 20*d* is a force-displacement curve for a confirming pad and a shock absorption element in series.
Figure 20A:
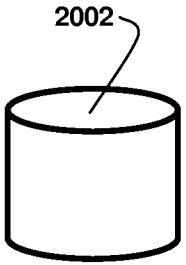
Fig. 20a (prior art)
FIG. 20*a* is an isometric view of a prior art pad.
Figure 20B:
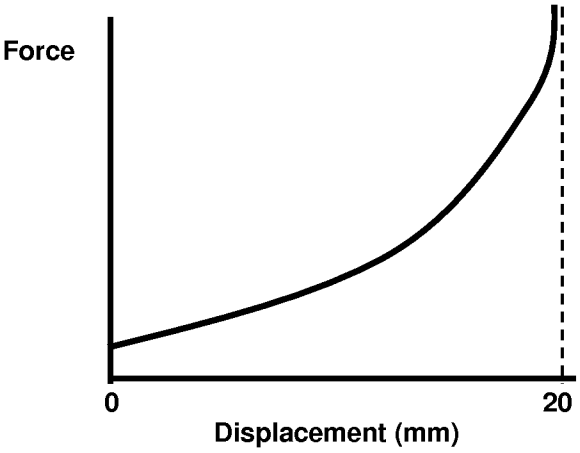
Fig. 20b (prior art)
FIG. 20*b* is a force-displacement curve for a prior art pad.

FIG. 20*a* shows an isometric view of a prior-art padding element at 2002 that could be incorporated into a pad of the type described in this disclosure. The prior art padding element 2002 exhibits the force-displacement curve shown in FIG. 20*b*, when the pad is in actual use. For example, in football helmets a typical prior art pad 2002 has a typical displacement of less than 20 mm in actual use before the pad is completely compressed. The force-displacement curve has a positive slope throughout its entire range. There is an initial force required before any displacement occurs because the pad is pre-loaded against the person's body. This preload is shown by the y-axis intercept at 0 mm of displacement in FIG. 20*b*. The force rises steeply as displacement increases and the rate of increase per unit of displacement increases (i.e. the slope of the curve increases) until the displacement approaches the maximum displacement of the pad, at which point, the slope becomes asymptotically vertical because the pad 2002 is fully compressed. This asymptotic line is shown at a value of 20 mm in FIG. 20*b*. The shape and characteristics of the force-displacement curve shown in FIG. 20*b* is typical of that for prior art.

FIG. 20*c* shows a combination of two padding elements in series. Referring to FIG. 20*c* a first padding element is shown at 2004 and a second padding element is shown at 2006. In one embodiment, the first padding element 2004 is designed to be placed on the side of the pad closest to the skin and is called a skin conforming element. The second padding element is designed to provide the distance required to decelerate from the typical speeds of impact while minimizing the risk of exceeding an accelerations that could cause bodily injury, such as a concussion.

FIG. 20*d* illustrates a force deflection characteristic for the combination of the first padding element 2004 and second padding element 2006. To decelerate as much as possible without exceeding an unsafe force it is desirable to decelerate as linearly as possible. Since force equals mass times acceleration, this means that the resistance force of the shock absorption elements should be as linear as possible. The force displacement curve in FIG. 20*d* depicts a large region, in this case about 60 millimeters, in which the resistance force of the padding elements 2004 and 2006 is as flat (i.e. constant) as possible. The table below illustrates the relationship between speed of impact, displacement in this linear region (shown at 1808 in FIG. 20*d*), slope of the linear region (defined and calculated as [F2−F1]/F2), and maximum acceleration if this section of the force-displacement curve is responsible for dissipating the entire impact. The values in the table below for a slope of 1 were generated by assuming that jerk (the rate of change of acceleration as a function of time) is a constant. This generates the following simultaneous equations to be solved:

$$v=(1/2)jt^2 \text{ (if jerk is constant)}$$

$$x=(1/6)jt^3 \text{ (if jerk is constant)}$$

$$a=jt \text{ (if jerk is constant)}$$

where: x is displacement, v=velocity, a=acceleration, j=jerk, and t=time

| Impact speed | Slope | Displacement | Time | Maximum Acceleration |
|---|---|---|---|---|
| 10 meters/sec | 0 | 25 mm | 5 msec | 2000 m/sec$^2$ (200 g) |
| 5 meters/sec | 0 | 25 mm | 10 msec | 500 m/sec$^2$ (50 g) |
| 10 meters/sec | 0 | 50 mm | 10 msec | 500 m/sec$^2$ (50 g) |
| 5 meters/sec | 0 | 50 mm | 20 msec | 125 m/sec$^2$ (12.5 g) |
| 10 meters/sec | 1 | 25 mm | 7.5 msec | 2667/sec$^2$ (267 g) |
| 5 meters/sec | 1 | 25 mm | 15 msec | 667/sec$^2$ (67 g) |
| 10 meters/sec | 1 | 50 mm | 15 msec | 667/sec$^2$ (67 g) |
| 5 meters/sec | 1 | 50 mm | 30 msec | 167/sec$^2$ (16.7 g) |

Another embodiment can have an exterior surface with a combination of flexible and rigid elements to provide flexibility and protection. Combinations of different impact reducing mechanisms can be used within the same pad, such as using a spring with internal piston mechanism, either together, in series, or in parallel. A simple pad could include a configuration in which the outer padding acts as a resilient piston mechanism, collapsing on its own, with a small orifice, that allows the escape and intake of air. The air-retaining region of the pad could be filled with a foam material. The region that includes the dimples could be sealed and have an active orifice to allow air to escape from the sealed dimpled area, into the remaining pad with compression or impact of the exterior surface of the padding. Interior elements of the pad can be comprised of elastic spring mechanisms, or piston mechanisms, or a combination of these types of elastic and resilient mechanisms. These described elements can be configured in parallel or in series within the impact padding. The interior elements can be comprised of single-acting cylinders, pressurized at one end only, with the opposite end vented to atmosphere or vented to the remaining interior reservoir. The interior elements can be configured as a series of tandem cylinders comprising two cylinders mounted in line with the pistons, connected by a common piston rod, or other embodiments not necessarily limited to the particular embodiments discussed. Orifices (passive and active) can be in the piston mechanisms or in the exterior padding to provide a superior force displacement type of impact padding.

In another embodiment haptically based sensors can inform the wearer of any abnormal data acquired. The data can be logged. The wearer can be informed using an audio alarm, a visual alarm, or a tactile alarm.

In another embodiment the surface of the impact pad that is most distant from the surface of the skin, can also be comprised of an impenetrable material. In another embodiment, the surface of the impact pad can be changed in density and hardness or can exhibit a characteristic of automatic strain hardening prior to the impact with the aid of sensors that detect an impending impact. The embodiments described can further comprise an integrated remote and wireless system to check the function of the sensors (e.g. detect the sensor failure or if it is properly functioning).

Further improvements that can be made to any of the embodiments described can include:

1. The addition of sensors to warn of an impending impact. These impact-detection sensors could be used to deploy additional padding such as air bags outside of the outer shell.
2. The use of inertial sensors in the impact padding. These sensors could measure the impact, record the impacts using data acquisition and data logging sensors, and/or transmit impact information using a wireless protocol. Transmission can be in the ultra-high frequency band, which is from 300 Mhz to 3 Ghz, the super high frequency band, which is from 3 Ghz to 30 Ghz, or the extremely high frequency band, which is from 30 Ghz to 300 Ghz. The sensed impacts could generate alarms that can be auditory, visual, tactic, or communicated to the padding of the wearer or another person at another location. The sensors could be self-adjusting based on a measurement of background noise or based on calibration to a specific user and use profile. The sensors could change an alarm in response to history. The sensors could provide feedback to the shock absorption elements in the padding material to help tune the shock absorption elements.
3. The use of sensors can be responsive to remote assistance whereby a remote device or person could evaluate, correct, repair, or switch from sensor to sensor. Similarly, another person (remotely) could evaluate individual sensors and then use data logging and evidence-driven information to make changes to the sensors.
4. Physiological biosensors, in contact with the skin, could actively stream a person's biometric information. The physiologic information can include parameters such as heart rate, oxygen saturation, blood pressure, changes in neural activity such as an EEG, and body temperature. Additionally these physiologic biosensors can detect respiratory rate, hematocrit, hemoglobin, blood volume values, electrolyte abnormalities and hydration levels. This real-time data acquired and logged can be available to the wearer, if abnormal, or can be transmitted to a remote source. These physiologic biosensors could also used for alcohol monitoring. The physiological biosensors could provide real time and continued biometric information to remote locations. These biometric sensors could be located closest to the person's skin surface. Any of the sensors listed here, or others capable of being understood by anyone skilled in the art may also provide a user with his or her own biometric data changes. Such sensor elements or sensor layer could also be embedded in any other element or layer of the pad.
5. The use of nanoscale physiologic biosensors. Hybridization of nanoscale metals and carbon nanotubes into composite nanomaterials has produced some of the best-performing biosensors to date. A scalable nanostructured biosensor based on multilayered graphene petal nanosheets (MGPNs), Pt nanoparticles, and a biorecognition element would be such an example for an embodiment of this invention. The combination of zero-dimensional nanoparticles on a two-dimensional support that is arrayed in the third dimension can create a biosensor platform with exceptional characteristics.
6. The data received from the physiologic biosensors could be used to detect abnormal values and initiate actions to inform the user and/or remote observers.
7. Active and/or passive sensor elements could be embedded in the impact material. The sensors embedded in the padding in one embodiment can be responsive to acceleration, orientation, position, velocity, and have the ability to sense the presence of another object or device in the vicinity. These integrated sensors in the padding can measure and integrate the directional and rotational impact force into real-time data, which could be interpreted and organized. These sensors specifically can sense an impending impact with another moving object or stationary object or stable platform. The active sensors could then alter the padding material prior to the impact in a manner to be more protective, than the "inactive" or pre-impact state. These sensors could detect the velocity of the oncoming object or person. The sensors could also detect the degree of impact and instantly alter the impact material or padding to adapt to a more protective state. The sensors related to the inflatable air system or fluid system, could internally adjust the amount of air in the sealed system to adapt to impacts or impending impacts to the body. Sensors further from the wearer's body could measure an impending impact, the type of impact (i.e. whether it is a projectile or a blunt object), impact speed, and impact direction. The combination of passive impact reduction technology with an active impact protection technology could have damping characteristics correlated in real-time with the weight, speed, contact surface and velocity of impending impact.

8. The sensors, embedded in the impact material, can have GPS (Global Positioning System) capability, which could actively stream location information to provide a tracking ability (e.g. with active positioning sensors). Sensors in the padding can also provide information about the wearer's identity. These sensors could be located on the outer shell or could be located closer to the person's body. These sensor elements located on the outer shell or close to the person's body can also allow the external aspects of the pad to be adjustable or tunable. This tunability can be in response to a controller, which receives its input signals from a sensor or sensors.
9. Embedded sensors could be self-adjusting, dependent on air pressure (external or atmospheric and internal padding pressures) and temperature (external or atmospheric and wearer's temperature) and to what has been pre-determined to be normal pressure in the padding for specific activities or impacts. These sensors could have impact threshold settings, which could be established and maintained remotely.
10. The characteristics of any of the layers of the pad could be responsive to signals received from any of the sensors disclosed. For example, the sensors could provide feedback to the shock absorption elements in the padding material to help tune the shock absorption elements. The sensors could produce a signal that changes the size, stiffness, springiness, or location of any part of the pad. Thus, a characteristic of the pad could be modified in real time or in delayed time in response to any sensed parameter such as a position, motion, acceleration, physiologic parameter, or any other parameter or adjustment capable of being understood by someone skilled in the art.
11. The exterior of the impact pad could be made of multiple elements that have the ability to move relative to one another and have energy absorption between them.
12. Parts of the impact pad could be made to be replaceable. Embodiments of the present invention can include having replaceable sensors. Embodiments can include having energy absorbing elements that can be replaceable as a result of impact, wear, etc. Embodiments can include having resilient elements that are replaceable. Embodiments can include having body conforming elements that are replaceable, or user installable.
13. Sensor elements embedded in the padding closest to the body's surface, and positioned near underlying bone can be of a bone conducting sound type of sensor to transmit sound or music to the wearer (e.g. can be related to a speaker).
14. Sensor elements embedded in the padding closest to the body's surface can be of a haptic type to transmit proprioceptive or positional sense information to the wearer.
15. Sensor elements embedded in the padding furthest from the body's surface (on external shell) can capture and transmit photographic images.
16. Sensor elements embedded in the padding closest to the body's surface could let users see how many calories they consume or burn.
17. Sensor elements embedded in the padding closest to the body's surface could enable users data-driven applications, from muscle, cardiac and respiratory fitness tracking
18. Infrared Thermography Sensor Elements embedded in the padding closest to the body's surface can be used for measuring temperature changes as well as evaluating vascular disease and the health of the skin and underlying muscle and soft tissue.

Although the invention herein has been described with reference to particular embodiments, it is to be understood that these embodiments are merely illustrative of the principles and applications of the present invention. For example, the present invention may be used to protect workers in an industrial setting, at a construction site, etc. In order to accomplish this, the device of the present invention may, for example, be included in construction helmets, knee pads, or standing pads. It is therefore to be understood that numerous modifications may be made to the illustrative embodiments and that other arrangements may be devised without departing from the spirit and scope of the present invention as defined by the appended claims.

A number of variations and modifications of the disclosed embodiments can also be used. The principles described here can also be used for in applications other than sports. While the principles of the disclosure have been described above in connection with specific apparatuses and methods, it is to be clearly understood that this description is made only by way of example and not as limitation on the scope of the disclosure.

What is claimed is:

1. A wearable impact reduction device comprising:

a first layer located closest to the wearer's body;

a second layer located further away from the wearer's body than the first layer wherein the second layer comprises an elastically resilient element arranged and configured to at least partially compress upon application of a force and to return elastically to its original shape upon removal of the force;

a third layer located further away from the wearer's body than the second layer;

a physiologic biosensor wherein the physiologic biosensor is responsive to a bioparameter associated with the wearer of the device;

a motion sensor; and a controller, wherein the controller comprises a microprocessor and a memory and the controller is responsive to the first sensor and the second sensor.

2. The device of claim 1 wherein:

the second layer further comprises a damping element wherein the damping element further comprises an orifice;

the physiologic biosensor is responsive to a bioparameter selected from the group of a blood chemistry, a blood pressure, a body temperature, a blood volume value, calorie consumption, an electro-cardio activity signal, a heart rate, a hematocrit measurement, a hemoglobin level, an infrared thermal image, neural activity, percent oxygenation, respiratory acidosis, a respiratory rate, a rhythm disturbance and vital signs;

the motion sensor is responsive to a parameter selected from the group of an acceleration, an orientation, a position, a velocity, a position associated with another object in the vicinity, a motion associated with another object in the vicinity, a position signal from another device in the vicinity, and a motion signal from another device in the vicinity;

a characteristic of the device is responsive to the controller; and the controller further comprises a communications element wherein the communications element transmits a signal responsive to a device selected from the group of the physiologic biosensor and the motion sensor using a communications protocol selected from the group of a WiFi signal, a cellphone signal, and a Blue Tooth signal.

3. The device of claim 2 wherein:

the physiologic biosensor is further responsive to a blood chemistry parameter selected from the group of an alcohol level, an electrolyte level, a glucose level, a hydration level, a pH, and an oxygen saturation;

the motion sensor is responsive to a parameter associated with another object in the vicinity; and the device further comprises a fourth layer located further from the wearers body than the third layer wherein the fourth layer is responsive to the motion sensor.

4. A wearable impact reduction device comprising:

a first layer located closest to the wearer's body;

a second layer located further away from the wearer's body than the first layer wherein the second layer comprises an elastically resilient element;

a third layer located further away from the wearer's body than the second layer;

a first sensor wherein the first sensor is responsive to a physiologic parameter associated with the wearer of the device; and a second sensor wherein the second sensor comprises a device selected from the group of an accelerometer, a gyroscope, a magnetometer, a an acoustic sensor, and infrared sensor, and a global positioning system receiver.

5. The device of claim 4 wherein the second sensor comprises an accelerometer and the device can be used to detect when a person is falling.

6. The device of claim 4 wherein the second layer comprises a sealable air bladder.

7. The device of claim 4 wherein a parameter of the second layer is responsive to a sensor selected from the group of the first sensor and the second sensor.

8. The device of claim 4 wherein:

the motion sensor is responsive to a parameter associated with another object in the vicinity; and the device further comprises a fourth layer located further from the wearers body than the third layer wherein the fourth layer is responsive to the second sensor.

9. The device of claim 4 further comprising a controller wherein the controller is responsive to a device selected from the group of the first sensor and the second sensor and the controller transmits a signal to a remote device using a communications protocol.

10. The device of claim 4 wherein the elastically resilient element comprises foam.

11. The device of claim 4 wherein the first sensor further comprises an infrared thermography sensor.

12. The device of claim 4 wherein the third layer comprises a plurality of elements that can move relative to one another.

13. The device of claim 4 wherein the second layer further comprises a user replaceable element.

14. The device of claim 4 wherein the device is a helmet.

15. The device of claim 4 wherein the device further comprises a haptic feedback device responsive to the motion sensor whereby the wearer can receive feedback information selected from the group of positional sense information and proprioceptive feedback information.

16. A method for reducing impact, the method comprising:

establishing a first layer closest to the wearer's body;

establishing a second layer further away from the wearer's body than the first layer wherein the second layer comprises a resilient element;

establishing a third layer further away from the wearer's body than the second layer;

establishing a first sensor wherein the first sensor is responsive to a biological parameter associated with the wearer of the device; and establishing a second sensor wherein the second sensor is responsive to a parameter selected from the group of an acceleration, an orientation, a position, a velocity, a parameter associated with another object in the vicinity, and a signal from another device in the vicinity.

17. The method of claim 16, the method further comprises:

establishing a controller responsive to a sensor selected from the group of the first sensor and the second sensor; and emitting an alarm signal when a sensor value beyond a threshold is received by the controller.

18. The method of claim 16 wherein the resilient element in the second layer comprises a material that resists with a constant force as a function of displacement.

19. The method of claim 16 further comprising establishing a fourth layer located further from the wearers body than the third layer wherein the fourth layer is responsive to a sensor selected from the group of the first sensor and the second sensor.

20. The method of claim 16 further comprising the step of having a layer selected from group of the first layer, the second layer, and the third layer responding to a signal from a sensor selected from the group of the first sensor and the second sensor.

* * * * *